US005364720A

United States Patent [19]

Nakazawa et al.

[11] Patent Number: 5,364,720

[45] Date of Patent: Nov. 15, 1994

[54] MAGNETIC DEVELOPER FOR DEVELOPING ELECTROSTATIC IMAGES

[75] Inventors: Akihiko Nakazawa, Kanagawa; Masayoshi Kato, Iruma; Manabu Ohno, Funabashi; Nobuyuki Okubo; Shunji Suzuki, both of Yokohama, all of Japan

[73] Assignee: Canon Kabushiki Kaisha, Tokyo, Japan

[21] Appl. No.: 135,974

[22] Filed: Oct. 14, 1993

[30] Foreign Application Priority Data

Oct. 15, 1992 [JP] Japan ..... 4-277234
Jan. 22, 1993 [JP] Japan ..... 5-026011
Jan. 29, 1993 [JP] Japan ..... 5-013560

[51] Int. Cl.[5] ..... G03G 9/083

[52] U.S. Cl. ..... 430/106.6; 430/110; 430/111

[58] Field of Search ..... 430/106.6, 110, 111

[56] References Cited

U.S. PATENT DOCUMENTS 3,578,797 5/1971 Hodges ..... 263/3
3,941,898 3/1976 Sadamatsu et al. .
4,868,084 9/1989 Uchide et al. ..... 430/110
5,041,351 8/1991 Kitamori et al. ..... 430/106.6
5,141,833 8/1992 Kitamori et al. ..... 430/102
5,164,780 11/1992 Ohno et al. ..... 355/251

FOREIGN PATENT DOCUMENTS 0468525 1/1992 European Pat. Off. .
41-20153 11/1966 Japan .
42-27596 12/1967 Japan .
44-6397 3/1969 Japan .
45-26478 9/1970 Japan .
51-23354 7/1976 Japan .
55-6805 2/1980 Japan .
55-18656 2/1980 Japan .
60753 4/1983 Japan ..... 430/106.6
6952 1/1985 Japan ..... 430/106.6
61-219959 9/1986 Japan .
62-279352 12/1987 Japan .
3-203749 5/1991 Japan .
4-240660 8/1992 Japan .

*Primary Examiner*—Roland Martin
*Attorney, Agent, or Firm*—Fitzpatrick, Cella, Harper & Scinto

[57] ABSTRACT

A magnetic developer for developing electrostatic images is constituted by magnetic toner particles, each containing a binder resin having a melt viscosity of at most $5.0\times10^6$ poise at 150° C. and a magnetic material. The magnetic material is blended with a proportion (C) [wt. %] of inorganic fine particles based on the magnetic material to carry 0.2–5 wt. % of the inorganic fine particles secured to the magnetic material surface. The magnetic material has a specific surface area (A) [$m^2/g$] before securing of the inorganic fine particles and is provided with an increase in surface area (B) [$m^2/g$] by the securing of the inorganic fine particles; wherein the parameters A, B and C satisfy the following formulae (1) and (2):

$$0.1 \leqq B/A \leqq 0.8 \quad (1)$$

$$B < 30\times C \quad (2).$$

As a result, the magnetic developer is provided with an improved low-temperature fixability without causing problems accompanying the use of a low-temperature softening binder resin, such as deterioration of anti-offset characteristic, storage characteristic, developing characteristic.

25 Claims, 2 Drawing Sheets

MAGNETIC DEVELOPER FOR DEVELOPING ELECTROSTATIC IMAGES

FIELD OF THE INVENTION AND RELATED ART

The present invention relates to a magnetic developer for use in an image forming method wherein an electrostatic image formed by e.g., electrophotography or electrostatic recording is developed with such a magnetic developer to form a toner image, and the toner image is transferred onto and fixed under heating on a recording material, such as paper, to form a visible image.

Heretofore, as a method for fixing a visible image of a developer (toner) onto a recording material, there has been frequently used a hot roller fixing system wherein a recording material carrying a yet-unfixed toner image is passed and heated under pressure between a hot roller maintained at a prescribed temperature and a pressure roller having an elastic layer and pressed against the hot roller.

As another fixing method, there is also known a belt or film fixing method as described in U.S. Pat. No. 3,578,797.

Hitherto, it has been practiced to add a waxy substance, such as low-molecular weight polyethylene or polypropylene, which sufficiently melts on heating to increase the releasability of the toner, thereby preventing the attachment of toner onto a fixing roller surface (i.e., off-set). The addition of such a waxy substance is actually effective for preventing such toner offset but, on the other hand, is liable to cause an increase in agglomeratability, unstable charging characteristic and inferior successive image forming characteristic of the resultant toner. Further, the addition of a large amount thereof results in a lower toner strength and a liability of toner sticking onto the surface of a photosensitive member, etc., and adversely affects the storage characteristics of the toner. Accordingly, various improvements in binder resin have been tried as another measure.

For example, it is known to increase the glass transition temperature (Tg) and/or molecular weight of a binder resin in a toner to improve the viscoelasticity of the toner. This method is, however, liable to result in an inferior-fixability, thus adversely affecting the low-temperature fixability, i.e., fixability at a low temperature, as required in a high-speed image forming system or economization of energy, in case where the improved anti-offset characteristic is ensured.

In order to improve the low-temperature fixability of a toner, it is generally required to lower the toner viscosity under melting to provide an increased adhesion area with a fixing substrate (recording paper), so that the binder resin used is required to have a lower Tg or molecular weight.

In this way, the low-temperature fixability and the anti-offset characteristic have mutually contradictory aspects, so that it is very difficult to develop a toner satisfying these properties in combination.

In order to provide solutions to the above problem, for example, there have been proposed a toner comprising a moderately crosslinked polymer obtained by adding a crosslinking agent and a molecular weight regulating agent (Japanese Patent Publication (JP-B) 51-23354), a toner having a broad molecular weight distribution as represented by a weight-average molecular weight/number-average molecular weight ratio in the range of 3.5–40 constituted from $\alpha$, $\beta$-unsaturated ethylenic monomers (JP-B 55-6805), and a toner comprising a blend of vinyl polymer having controlled Tg, molecular weight and gel content.

The toners according to these proposals actually provide a broader fixable temperature range as defined between the lowermost fixable temperature and the offset-initiation temperature, compared with a toner comprising a single resin having a narrow molecular weight distribution. However, these toners are still suffering from contradictions that the provision of a sufficient anti-offset characteristic is accompanied with an insufficient low-temperature fixability and, on the other hand, the improvement in low-temperature fixability is liable to be accompanied with an insufficient anti-offset characteristic.

In recent years, it has been an important problem to provide a smaller size of copying machine or printer for accomplishing economization of space, cost reduction and low power consumption, thus also providing a fixing apparatus which is smaller in size, simpler in structure and smaller in power consumption. Accordingly, the developer further necessitates a toner which principally comprises a resin component which is soft and has lower melt viscosity and Tg. As described above, however, it is difficult for such a developer to also satisfy a required anti-static characteristic, and such a developer involves problems of being liable to show inferior developing characteristic and storage characteristic and stick onto the photosensitive member. It is difficult to satisfy these properties in combination with a low-temperature fixability.

As a developing method using a highly insulating magnetic toner, there is known a type wherein toner particles are triboelectrically charged through friction between toner particles per se and between the toner particles and a friction member, such as a sleeve, etc., and the charged toner particles are caused to contact an electrostatic image-bearing member for development. According to this method, however, chances of contact between the toner particles and the friction member are reduced, thus being liable to provide an insufficient triboelectric charge. Further, the charged toner particles are liable to cause agglomeration on the sleeve because of enhanced Coulomb force between the sleeve and the charged toner particles.

Japanese Laid-Open Patent Application (JP-A) 55-18656 has proposed the so-called jumping development method having solved the above-mentioned problem. According to the method, a magnetic toner is applied in a very thin layer and triboelectrically charged on a sleeve and is caused to be in close proximity with an electrostatic image to develop the image. In the method, the opportunity of contact between the toner and the sleeve is increased by applying the toner in a very thin layer on the sleeve, thereby allowing sufficient triboelectrification, and a magnet is disposed within the sleeve to support the magnetic toner, and disintegrate the agglomerated toner and cause sufficient friction of the toner with the sleeve by relative movement between the magnet and the toner. Owing to these features, excellent images can be formed.

The above-mentioned improved method of using an insulating toner is accompanied with an unstability factor attributable to the insulating toner used. That is, the insulating toner contains a substantial amount of fine powdery magnetic material in mixture and in a dispersed state, and a portion of the magnetic material is exposed to the surface of toner particles. As a result, the magnetic material, depending on its kind, affects the fluidity and triboelectric chargeability of the magnetic toner, thus being liable to cause a fluctuation or deterioration in various properties required of the magnetic toner, such as developing characteristic and successive image forming characteristic.

In the jumping development method using a magnetic toner containing a conventional magnetic material, the magnetic toner comprising the magnetic material is liable to have inferior fluidity, thus failing to have a normal triboelectric charge and having unstable charges, on continuation of repetitive developing operation (e.g., for copying) in a long term. Particularly, in a low temperature—low humidity environment, fog development is liable to occur, thus resulting in a serious defect in the toner image. Further, in case where the binder resin and the magnetic material constituting the magnetic toner particles show a weak adhesion with each other, the magnetic material is liable to be taken off from the magnetic toner surface on repetitive developing operation, thus causing adverse effects, such as a lowering in toner image density.

In case where the magnetic material is ununiformly dispersed within magnetic toner particles, relatively small magnetic toner particles containing much magnetic material are liable to be accumulated on the sleeve, thus resulting in a lowering in image density and a density irregularity called "sleeve ghost" in some cases.

Several proposals have been made regarding magnetic materials to be contained in magnetic toners. For example, JP-A 62-279352 has proposed a magnetic toner containing magnetic iron oxide containing siliceous element. In the magnetic iron oxide, the siliceous element is intentionally caused to be present at the inner part of magnetic iron oxide particles. The magnetic toner containing such a magnetic iron oxide has left points to be improved regarding the fluidity.

SUMMARY OF THE INVENTION

An object of the present invention is to provide a magnetic developer having solved the above-mentioned problems, more specifically a magnetic developer having a good fixability at a small heat supply and not readily causing offset phenomenon.

Another object of the present invention is to provide a magnetic developer free from causing image defects due to sticking of the magnetic developer onto the photosensitive member surface.

Another object of the present invention is to provide a magnetic developer having an excellent storage stability.

Another object of the present invention is to provide a magnetic developer capable of providing images having a high density and excellent resolution.

Another object of the present invention is to provide a magnetic toner excellent in durability and free from deterioration in image density or image quality even on repetitive use for a long period.

Another object of the present invention is to provide a magnetic toner free from image defects, such as hollow images, due to transfer dropout or failure.

Another object of the present invention is to provide a magnetic toner free from causing surface damages on the photosensitive member due to externally added particles and sticking of the developer caused thereby.

A further object of the present invention is to provide a magnetic developer containing a magnetic toner capable of providing images having a high image density and excellent in resolution under various environmental conditions.

According to the present invention, there is provided a magnetic developer for developing electrostatic images, comprising: magnetic toner particles, each containing a binder resin having a melt viscosity of at most $5.0\times10^6$ poise at 150° C. and a magnetic material, wherein said magnetic material is blended with a proportion (C) [wt. %] of inorganic fine particles based on the magnetic material to carry 0.2–5 wt. % of the inorganic fine particles secured to the magnetic material surface, and said magnetic material has a specific surface area (A) [$m^2/g$] before securing of the inorganic fine particles and is provided with an increase in surface area (B) [$m^2/g$] by the securing of the inorganic fine particles;

wherein the parameters A, B and C satisfy the following formulae (1) and (2):

$$0.1 \leqq B/A \leqq 0.8 \quad (1)$$

$$B < 30\times C \quad (2).$$

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
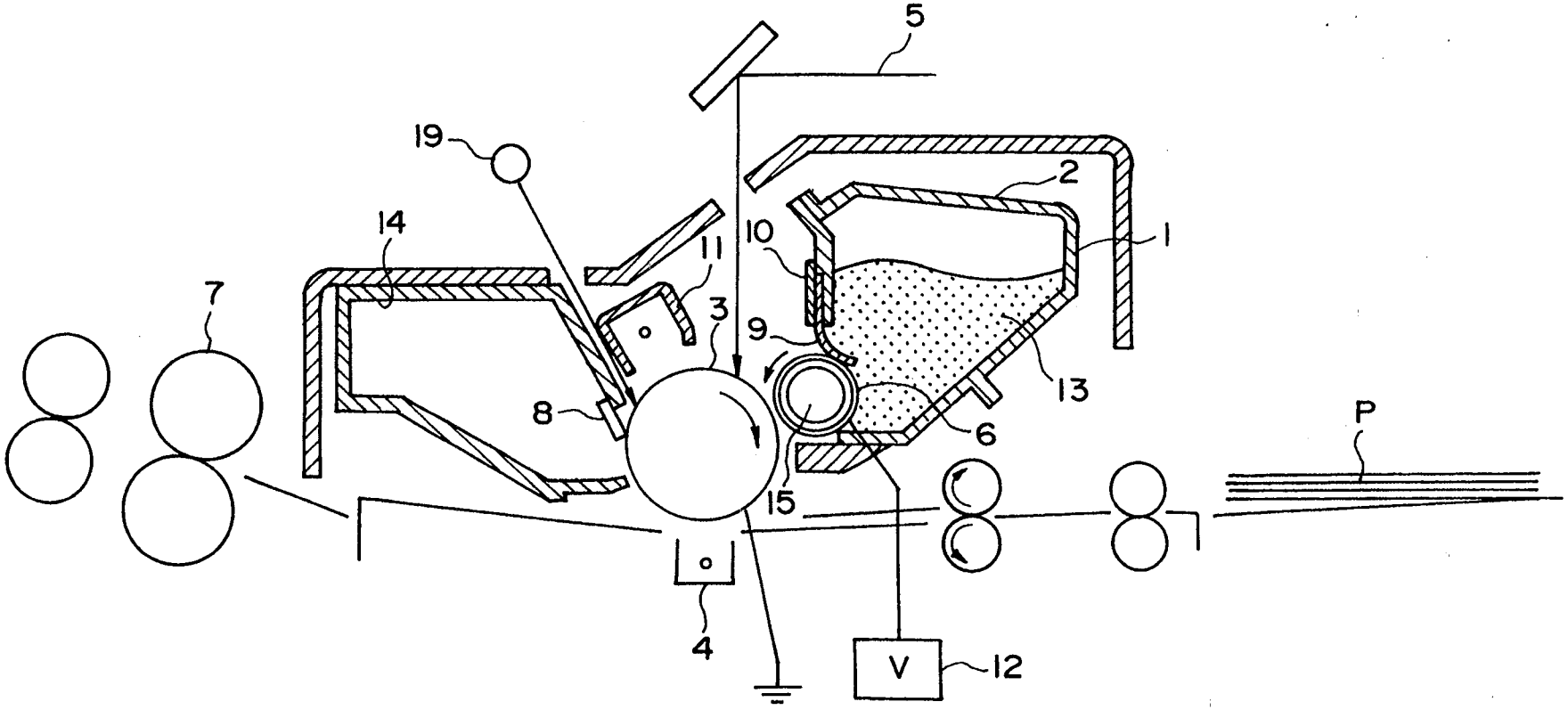
FIG. 1 is an illustration of an image forming apparatus to which the magnetic developer of the invention is applicable.

The reason why the magnetic developer according to the present invention shows the above-mentioned effects may be considered as follows.

If a great importance is attached to the fixability, the developer is naturally caused to be one showing a low melt viscosity, thus being liable to cause offset.

The magnetic material used in the present invention has inorganic fine particles secured to the surface thereof, e.g., by a mechanical treatment, so as to satisfy the above-mentioned formulae (1) and (2). As a result, the magnetic material is provided with moderately fine surface unevenness, so that the magnetic material may exhibit an appropriate degree of thickening effect at the time of melt-fixation of the developer transferred onto transfer paper, thus providing an improved anti-offset effect. Accordingly, compared with the use of a resin component showing a high melt viscosity as a conventional technique for improving the anti-offset characteristic, the deterioration of fixability is minimized. Further, compared with the addition of a large amount of a release agent showing a plasticity, such as low-molecular weight polyethylene, as another technique for improving the anti-offset characteristic, the developer according to the present invention is less liable to suffer from adverse effects against the storage characteristic and developing characteristic.

In the magnetic material used in the present invention, the inorganic fine particles are secured or firmly affixed to the surfaces of the magnetic material while retaining their particle shape. In the state of using the toner, the inorganic fine particles are not readily released even on repetitive friction or pressure application between the toner particles and between the toner particles and another member. Such a firmly affixed state of the inorganic fine particles may be confirmed by subjecting the magnetic material carrying the inorganic fine particles to ultrasonic washing and measuring the change in amount of the inorganic fine particles affixed to the magnetic material. The inorganic fine particles secured to the surface of the magnetic material is so firmly affixed that they do not show a substantial change in amount thereof affixed to the magnetic material even by such ultrasonic washing. Such a substantial freeness from liberation may be confirmed by the detection of 95% or more of the inorganic fine particles after the ultrasonic washing compared with the amount before the washing if a possible measurement error is taken into consideration.

Ordinarily, a substantial proportion of a magnetic material is believed to be exposed to the surface of a magnetic toner particle. Accordingly, even if externally added inorganic fine particles present on the magnetic toner surfaces are embedded into the toner particles due to a long term of continuous use, the inorganic fine particles secured to magnetic material particles exposed at the surfaces of the magnetic toner particles are allowed to remain on the toner surfaces in a similar form as externally added particles, thus suppressing deterioration of chargeability and fluidity.

Further, at the time of transfer, the externally added particles and the inorganic fine particles secured to the magnetic material surfaces may interact on each other to prevent the agglomeration of the toner and improve the releasability of the toner from the photosensitive member, thus preventing occurrence of transfer failure.

As a result, it is possible to avoid addition of excessive amount of externally added particles, thus alleviating the occurrence of damages on the photosensitive member and sticking of the toner caused thereby.

A developer having a low melt viscosity involves a problem that it is liable to stick onto the photosensitive member surface on repetitive use, but the inorganic fine particles secured to the magnetic material particles appearing at the magnetic toner particle surfaces show an abrasive effect, thus preventing the sticking of the developer onto the photosensitive member.

On the other hand, under environmental conditions of high temperature—high humidity, the toner is generally liable to lose chargeability due to moisture attached to the toner surface, thus resulting in a lower image density and an inferior image quality. Such a problem may be well prevented by securing preliminarily hydrophobicity-imparted inorganic fine particles to the magnetic material in the present invention, thereby improving the chargeability under high temperature—high humidity conditions.

Further, by such a surface treatment, it is possible to improve the releasability from the photosensitive member, thus preventing transfer dropout or failure.

As described above, the magnetic toner according to the present invention can be provided with excellent performances in all aspects of fixability, anti-offset characteristic, environmental stability, little deterioration in long use, and freeness from transfer dropout. Thus, the magnetic toner according to the present invention is believed to be estimated as a very useful one which alleviates the defects of a low-melt viscosity toner and satisfies a high fixability and other properties required of a toner.

On the other hand, a developer having a low-melt viscosity can adversely affect the developing performance of the developer. A factor causing such an adverse effect is that a sufficient shearing force is not imparted during the melt-kneading of the developer components, thus being liable to cause inferior dispersion. However, because of the above-mentioned effective thickening effect, the magnetic material used in the present invention can enhance the shearing force to improve the dispersion of the other components, thereby improving the developing performance of the magnetic toner.

In this way, the magnetic material used in the present invention is very effective in alleviating the defects of a low-melt viscosity and providing the developer with an excellent fixability and other properties required of the developer in combination.

In order to exhibit such performances, the magnetic developer according to the present invention is required to satisfy the above-mentioned specific requirements.

The binder resin is required to show a melt viscosity of at most $5.0\times10^6$ poise, preferably $1\times10^3$–$1\times10^6$ poise, at 150° C., in order to provide a sufficient low temperature fixability.

Inorganic fine particles are added in an amount of C wt. % (equal to 0.2–5 wt. % secured to the magnetic material or a little more) with respect to the magnetic material and firmly affixed, to the magnetic material by a mechanical treatment. As described above, such a strongly affixed state of the inorganic fine particles are expressed by the term of "secured to the magnetic material surface". If the amount is below 0.2 wt. %, a required effect of improving the anti-offset characteristic is not attained. In excess of 5 wt. %, it becomes difficult to completely secure the inorganic fine particles, and the resultant isolated inorganic fine particles can cause not only an inferior fixability but also an inferior developing characteristic.

It is important that the specific surface area (A) [$m^2/g$] of the magnetic material and the increment in surface area (B) [$m^2/g$] by the securing of the inorganic fine particles satisfy the following formula (1):

$$0.1 \leqq B/A \leqq 0.8 \quad (1).$$

It is preferred that the B/A ratio is within the range of 0.3–0.6.

If the ratio of below 0.1, the effect of addition of the inorganic fine particles cannot be attained. In excess of 0.8, the increase in viscosity becomes excessive, thus adversely affecting the fixability. Further, not only under high temperature—high humidity conditions liable to cause a lowering in toner chargeability, but also in a normal environment, the problems of inferior image quality and insufficient image density are liable to occur. It is also important that the increment in specific surface area (B) and the addition amount (C) [wt. %] of the inorganic fine particles satisfy the following formula:

$$B < 30\times C \quad (2).$$

It is preferred to satisfy $B<20\times C$, particularly $B<15\times C$.

The excess of (S) than specified by the formula (2) means a case wherein very fine inorganic fine particle are used or a case wherein the magnetic material or inorganic fine particles have been pulverized into fine particles under extreme mechanical pressure. In the former case, the agglomeration of the inorganic fine particles is intense so that it becomes difficult to disperse and secure the inorganic fine particles onto the magnetic material, the failing to obtain a uniform magnetic material. In the latter case, a large number of the pulverizate in mixture results in remarkably inferior fixability and developing characteristic.

It is further preferred that the specific surface area (D) [$m^2/g$] of the inorganic fine particles satisfies the following relationship in combination with the above parameters (B) and (C).

$$0.4\leqq B/(0.01\times C\times D)\leqq 2.5 \quad (3)$$

It is further preferred to satisfy:

$$0.6\leqq B/(0.01\times C\times D)\leqq 1.8.$$

A value of formula (3) being below 0.4 means too weak a mechanical treatment causing isolation of the inorganic fine particles without attachment to the magnetic material surface or too strong a mechanical treatment causing embedding of the inorganic fine particles within the magnetic material. It is difficult to obtain desired performances by using such a magnetic material.

A value of formula (3) exceeding 2.5 is considered to mean pulverization of the inorganic fine particles and the magnetic material into finer particles due to extreme mechanical pressure, so that the above-mentioned problems can be encountered.

By satisfying the above requirements, it is possible to obtain a magnetic developer containing a magnetic material to the surface of which inorganic fine particles have been secured without causing isolated inorganic fine particles, thus accomplishing the objects of the invention including good performances during a large number of successive image formation.

Examples of the magnetic material to be used in combination with inorganic fine particles in the present invention may include: ferrite, magnetite; metals, alloys or compounds comprising a ferromagnetic element, such as iron, cobalt, or nickel; alloys not containing a ferromagnetic element but capable of showing through an appropriate heat treatment, etc., such as Heusler's alloys containing manganese and copper inclusive of manganise-copper-aluminum and manganese-copper-tin; and chromium dioxide. Magnetic material particles may assume any shapes, inclusive of sphere, octahedron and hexahedron. The magnetic material may preferably have a specific surface area of 4–15 $m^2/g$, more preferably 5–12 $m^2/g$, in view of dispersibility thereof in the binder resin. The magnetic material in powdery form may preferably be contained in a proportion of 30–150 wt. parts, more preferably 40–120 wt. parts, per 100 wt. parts of the binder resin.

The inorganic fine particles added to the magnetic material in the present invention may comprise, e.g., an inorganic oxide, such as silica, titania, alumina, zirconium oxide, magnesium oxide, zinc oxide or cerium oxide; or a nitride, such as boron nitride, aluminum nitride, or carbon nitride. It is possible to use plural species of inorganic fine particles in combination.

The inorganic fine particles may preferably have a specific surface area of 50–500 $m^2/g$, more preferably 80–450 $m^2/g$, further preferably 110–400 $m^2/g$, in view of the securing thereof to the magnetic material surface. The addition amount (C) of the inorganic fine particles may preferably be 0.1–3.5 wt. %, more preferably 0.2–3 wt. %, of the magnetic material. A possible portion within C (wt. %) of the inorganic fine particles, if not secured to the magnetic material surface, may generally be contained in the magnetic toner particles in an isolated form.

The means for mechanically treating the magnetic material and the inorganic fine particles to secure the inorganic fine particles to the surface of the magnetic material need not be particularly limited. Examples thereof may include: ball mills, roll mills, batch-type kneaders, Nauter mixer, and Mix-mailer.

These inorganic fine particles may be surface treated, as desired, e.g., with oil, such as silicone oil, or various coupling agents in known manners.

It is possible to use a plurality of treating agents in combination.

The inorganic fine particles secured to the magnetic material may preferably be surface-treated to have a hydrophobicity of at least 30%, more preferably at least 50%. A hydrophobicity of below 30% will not provide a sufficient effect of the surface treatment.

It is possible to apply the hydrophobicity-imparting treatment to the inorganic fine particles already secured to the magnetic material.

The hydrophobicity of the inorganic fine particles may be determined in the following manner. Surface-treated inorganic fine particles in an amount of 0.2 g is added to 50 ml of water in a 250 ml-Erlenmeyer flask. While stirring the content in the flask by a magnetic stirrer, methanol is added to the flask until all the inorganic fine particles are wetted therewith. The end point is observed by suspension of all the inorganic fine particles, and the hydrophobicity is expressed by the percentage of methanol in the methanol-water mixture at the end point.

The inorganic fine particles may be treated with oils or various coupling agents as shown below.

Examples of oils may include: silicone oils, such as dimethylsilicone oil, methylhydrogensilicone oil, alkyl-modified silicone oil, α-methylstyrene-modified silicone oil, chlorophenylsilicone oil, and fluorine-modified silicone oil. Examples of the coupling agents may include: dimethyldichlorosilane, trimethylchlorosilane, allyldimethylchlorosilane, hexamethyldisilazane, allylphenyldichlorosilane, benzyldimethylchlorosilane, vinyltrimethoxysilane, γ-methacryloxypropyltrimethoxysilane, vinyltriacetoxysilane, divinylchlorosilane, and dimethylvinyl chlorosilane. Surface-treating agents need not be restricted to these materials if the above-mentioned hydrophobicity can be attained.

The surface-treating method is not restricted particularly, and a known method may be applied. For example, the inorganic fine particles and an oil may be directly mixed in a mixer, such as a Henschel mixer, or the oil may be sprayed onto the inorganic fine particles. It is also possible to mix a solution of an oil with the inorganic fine particles and then evaporate the solvent.

Similarly, the treatment with a coupling agent may be effected, e.g., in a dry process wherein a cloud of inorganic fine particles are reacted with gasified coupling agent, or in a wet process wherein inorganic fine particles are dispersed in a solvent and a coupling agent is added thereto for reaction.

Examples of the binder resin may include: polystyrene; homopolymers of styrene derivatives, such as polyvinyltoluene; styrene copolymers, such as styrene-propylene copolymers, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; and vinyl resins, such as polymethyl methacrylate, polybutyl methacrylate and polyvinyl acetate. These resins may be used singly or in combination of two or more species.

The binder resin can also be a polyester resin prepared from a di- or poly-hydric alcohol and a di- or poly-basic carboxylic acid. Examples of the dihydric alcohol may include: diols, such as ethylene glycol, diethylene glycol, triethylene glycol, 1,2-propylene glycol, 1,3-propylene glycol, 1,4-butanediol, neopentyl glycol, and 1,4-butenediol; 1,4-bis(4-hydroxymethylcyclohexane); and etherified bisphenols, such as bisphenol A, hydrogenated bisphenol A, polyoxyethylene-modified bisphenol A, and polyoxypropylene-modified bisphenol A. Examples of the dibasic carboxylic acid may include: maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, anhydrides and low alkyl esters of these acids, and dimer of linolenic acid.

Examples of the polyhydric alcohol having three or more functional groups may include: sorbitol, 1,2,3,6-hexanetetrol, 1,4-sorbitane, pentaerythriol, dipentaerythritol, tripentaerythritol, sucrose, 1,2,4-butanetriol, glycerol, 2-methylpropanetriol, 2-methyl-1,2,4-butanetriol, trimethylolethane, trimethylol-propane, and 1,3,5-tri-hydroxymethylbenzene. Examples of the polybasic carboxylic acid having three or more hydroxyl groups may include: 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, empole trimeric acid, and anhydrides of these acids.

The toner constituting the developer according to the present invention can contain a resinous material in addition to the above binder resin in a small amount than the binder resin.

Examples of such a resinous material may include: silicone resin, polyurethane, polyamide, epoxy resin, polyvinyl butyral, rosin, modified rosin, terpene resin, phenolic resin, aliphatic or alicyclic hydrocarbon resins, such as low-molecular weight polyethylene and low-molecular weight polypropylene, aromatic petroleum resin, chlorinated paraffin, and paraffin wax.

The magnetic toner according to the present invention can contain a colorant, which may be selected from known dyes and/or pigments.

The magnetic toner according to the present invention can contain a charge control agent. Examples of a positive charge control agent may include: nigrosine, azine dyes having 2–16 carbon atoms (JP-B 42-1627); basic dyes including, e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44025), C.I. Basic Green 1 (C.I. 42040), C.I. Basic Green 4 (C.I. 42000), and lake pigments formed from these basic dyes with laking agents, such as phosphotungstic acid, phosphomolybdic acid, phosphotungsticmolybdic acid, tannic acid, lauric acid, gallic acid, ferricyanic compounds, and ferrocyanic compounds; C.I. Solvent Black 3 (C.I. 26150), Hansa Yellow G (C.I. 11680), C.I. Mordant Black 11, and C.I. Pigment Black 1; triphenylmethane compounds; quarternary ammonium chlorides, such as benzomethyl-hexadecylammonium chloride, and decyltrimethylammonium chloride; polyamides, such as amino group-containing vinyl polymers and amino group-containing condensate polymers. Preferred examples thereof may include: nigrosine, quarternary ammonium salts, triphenylmethane-type nitrogen-containing compounds, and polyamides.

Examples of the negative charge control agent may include: metal complexes of monoazo dyes disclosed in JP-B 41-20153, JP-B 42-27596, JP-B 44-6397 and JP-B 45-26478; nitroamino acid and salts thereof, and dyes or pigments such as C.I. 14645; complexes of metals such as Zn, Al, Co, Cr and Fe with salicylic acid, naphthoic acid and dicarboxylic acids, sulfonated copper-phthalocyanine pigments, styrene oligomers having introduced into group or halogen, and chlorinated paraffin. In view of dispersibility, it is particularly preferred to use metal complexes of monoazo dyes, metal complexes of salicylic acid, metal complexes of alkylsalicylic acids, metal complexes of naphthoic acid, and metal complexes of dicarboxylic acids.

The above-charge control agent may preferably be added in a proportion of 0.1–3 wt. parts per 100 wt. parts of the binder resin so as to retain an improved triboelectric chargeability while suppressing adverse side effects, such as a lowering in developing performance and a lowering in environmental stability due to soiling of the developing sleeve with the charge control agent to the minimum.

The magnetic toner according to the present invention can further contain an ethylene-type olefin polymer or copolymer as a fixing aid in addition to the binder resin.

Examples of the ethylene-type olefin polymer or copolymer may include: polyethylene, polypropylene, ethylene-propylene copolymer, ethylene-vinyl acetate copolymer, ethylene-ethyl acrylate copolymer, and ionomers having a polyethylene skeleton. The copolymer may preferably contain at least 50 mol. %, more preferably at least 60 mol. %, of the olefin monomer.

The magnetic toner constituting the magnetic developer according to the present invention may preferably have a weight-average particle size of 3–9 μm in view of the developing characteristic and resolving power thereof.

The developer may contain silica fine powder or another metal oxide fine powder in order to provide an improved fluidity or control of chargeability.

It is preferred to add inorganic fine particles having a BET specific surface area of at least 50 $m^2/g$ to the magnetic toner in a proportion of 0.1–3 wt. % of the magnetic toner.

It is further preferred to cause inorganic fine particles having a specific surface area of at least 50 $m^2/g$, more preferably at least 100 $m^2/g$, to attach to the surface of the magnetic toner particles in a proportion of 0.1–3 wt. % of the magnetic toner. If the amount of the externally added particles is below 0.1 wt. % or the specific surface area thereof is below 50 $m^2/g$, the effect of the addition is scarce. In excess of 3 wt. %, the toner fixability is liable to be lowered and the dispersion of the externally added particles is liable to be ununiform, thereby causing ununiform charge of the toner and damage of the photosensitive member.

The externally added fine particles may comprise the same species as the inorganic fine particles secured to the magnetic material and may particularly preferably comprise silica fine powder, which can be either the so-called "dry process silica" or "fumed silica" which can be obtained by oxidation of gaseous silicon halide, or the so-called "wet process silica" which can be produced from water glass, etc. Among these, the dry process silica is preferred to the wet process silica because the amount of the silanol group present on the surfaces or in interior of the particles is small and it is free from production residue such as $Na_2O$, $SO_3^{2-}$. The dry process silica referred to herein can include a complex fine powder of silica and another metal oxide as obtained by using another metal halide, such as aluminum chloride or titanium chloride together with a silicon halide. The silica powder may preferably have an average primary particle size in the range of 0.001–2 μm, particularly 0.002–0.2 μm.

The externally added particles used in the present invention may preferably be treated with silicone oil in order to improve the environmental stability. By the silicone oil treatment, the silanol groups on the surfaces of the particles are completely covered to provide a remarkably improved moisture resistance.

The solid or resinous content in the silicone oil or silicone varnish may be represented by the following formula:

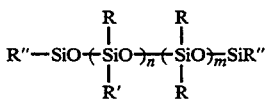

wherein R: a $C_1$–$C_3$ alkyl group, R′: a silicone oil-modifying group, such as alkyl, halogen-modified alkyl, phenyl, and modified-phenyl, R″: a $C_1$–$C_3$ alkyl or alkoxy group.

Specific examples thereof may include: dimethylsilicone oil, alkyl-modified silicone oil, α-methylstyrene-modified silicone oil, chlorophenyl-silicone oil, and fluoro-modified silicone oil. The above silicone oil may preferably have a viscosity at 25° C. of about 50–1000 centi-stokes. A silicon oil having too low a molecular weight can generate a volatile matter under heating, while one having too high a molecular weight has too high a viscosity leading to a difficulty in handling.

In order to treat the silica fine powder with silicone oil, there may be used a method wherein silica fine powder treated with a silane coupling agent is directly mixed with a silicone oil by means of a mixer such as Henschel mixer or a method wherein a silicone oil is sprayed on silica as a base material. It is further preferred to use a method wherein a silicone oil is dissolved or dispersed in an appropriate solvent, the resultant liquid is mixed with silica as a base material, and then the solvent is removed to form a hydrophobic silica.

It is further preferred to treat the silica fine powder first with a silane coupling agent and then with silicone oil or silicone varnish.

When the inorganic fine powder is treated only with silicone oil, a large amount of silicone oil is required in order to cover the surface of the silica fine powder, so that the silica fine powder can agglomerate to provide a developer with a poor fluidity and the treatment with silicone oil or varnish must be carefully performed. However, if the silica fine powder is first treated with a silane coupling agent and then with a silicone oil, the fine powder is provided with a good moisture resistance while preventing agglomeration of the powder and thus the treatment effect with silicone oil can be sufficiently exhibited.

The silane coupling agent used in the present invention may be hexamethyldisilazane or those represented by the formula: $R_mSiY_n$, wherein R: an alkoxy group or chlorine atom, m: an integer of 1–3, Y: alkyl group, vinyl group, glycidoxy group, methacryl group or other hydrocarbon groups, and n: an integer of 3–1. Specific examples thereof may include: dimethyldichlorosilane, trimethylchlorosilane, allyldimethylchlorosilane, allylphenyldichlorosilane, benzyldimethylchlorosilane, vinyltriethoxysilane, γ-methaceryloxypropyltrimethoxysilane, vinyltriacetoxysilane, divinylchlorosilane, and dimethylvinylchlorosilane.

The treatment of the fine powder with a silane coupling agent may be performed in a known manner, e.g., in a dry process wherein the fine powder is agitated to form a cloud with which a vaporized or sprayed silane coupling agent is reacted, or in a wet process wherein the fine powder is dispersed in a solvent into which a silane coupling agent is added dropwise to be reacted with the fine powder.

It is preferred to treat 100 wt. parts of the externally added particles with 1–50 wt. parts, more preferably 5–40 wt. parts, of the silane coupling agent.

Further, it is preferred to treat 100 wt. parts of the externally added particles with 1–35 wt. parts, more preferably 2–30 wt. parts, of silicone oil or varnish. If the amount of silicone oil is too small, the resultant effect is the same as that obtained by treatment with the silane coupling agent alone, thus failing to provide a sufficient moisture resistance and to provide high-quality images in a high-humidity environment due to moisture absorption. On the other hand, if the amount of the silicone oil is too large, the externally added particles are liable to agglomerate and liberate the silicone oil in an isolated form, in extreme case, thus failing to improve the fluidity when added to the toner.

The externally added particles may be blended with the toner by a Henschel mixer, etc., to be attached to the surface of the toner particles. The externally add particles comprise the same species as or different species from the inorganic fine particles secured to the magnetic material.

Next, the methods of measuring the melt viscosity and the specific surface area characterizing the present invention will be described.

Figure 2:
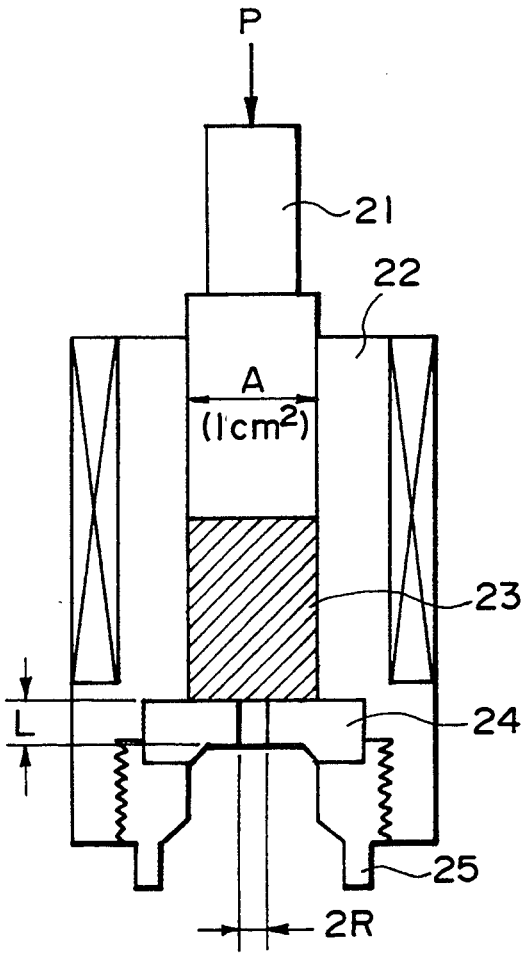
FIG. 2 is a sectional illustration of a Kohka-type flow tester used for melt viscosity measurement.

The melt viscosity of a binder resin or a toner may be measured by a Kohka-type flow tester ("Flow Tester CFT-500" (trade name), mfd. by Shimazu Seisakusho K. K.) as shown in FIG. 2. About 1.5 g of a sample is preliminarily shaped in a pressure molding device. The thus shaped sample 23 is placed within a cylinder 22 heated to a constant temperature and supplied with a load of 10 kg.f by a plunger 21 to be extruded through a die or nozzle 24 having a bore measuring 1 mm in diameter (2R) and 1 mm in length (L) and held by a die holder 25, whereby he plunger descending rate (rate of sample extrusion) is measured. The sample extrusion rate is measured at various temperatures at an interval of 5° C. within the range of 100°-180° C. From each measured value, an apparent viscosity $\eta'$ [poise] is calculated by the following equation:

$$\eta' = TW'/DW' = \pi PR^4/(8LQ) \text{ [poise]}$$

wherein $$TW' = PR/(2L)[\text{dyne/cm}^2]$$

$$DW' = 4Q/(\pi R^3)[\text{sec}^{-1}],$$

$\eta'$: apparent viscosity [poise]

TW': apparent shear stress at nozzle wall

DW': apparent shear rate at nozzle wall

Q: extrusion rate [$cm^3$/sec=ml/sec]

P: extrusion pressure [dyne/$cm^2$]10 kg.f=$980\times10^4$ dyne

R: nozzle (bore) radius [cm]

L: nozzle (bore) length [cm]

From the calculated values of apparent viscosity at various temperatures, the apparent viscosity (melt viscosity) at 150° C. (or another specific temperature is obtained by interpolation.

The specific surface area (S) [$m^2$/g] of a magnetic material (before or after securing of inorganic fine particles) may be measured by a specific surface area meter ("Autosorb 1", mfd. by Yuasa Ionix K. K.) according to the BET method using nitrogen adsorption. The specific surface area (A) [$m^2$/g] of the magnetic material before the securing of inorganic fine particles may also be calculated by the following equation and used to obtain a difference in specific surface area (B) according to the securing of inorganic fine particles by subtraction (B=A−S).

$$A = [6/(\rho \times d_1) \times E, \text{ wherein}$$

A: specific surface area of magnetic material before securing of inorganic fine particles [$m^2$/g]

$\rho$: density of magnetic material (=5.2 g/cc)

$d_1$: number-average particle size (diameter) [μm] of magnetic material before securing of inorganic fine particles (obtained as an average of lengths of arbitrarily selected 200 particles in photograph taken through a TEM (transmission electron microscope)

E: coefficient defined as follows depending on the sphericity $\phi$ of magnetic material:

$$E = 1.35 \text{ when } \phi \geqq 0.8$$

$$E = 1.70 \text{ when } \phi < 0.8.$$

The sphericity $\phi$ is determined as an average of ratios (minimum length [μm]/maximum length [μm]) for arbitrarily selected 100 magnetic material particles in TEM photographs.

It has been confirmed that the calculate value of the specific surface area of a magnetic material before securing of inorganic fine particles according to the above equation shows a good agreement with the measured value of the specific surface area of the magnetic material according to the BET method using nitrogen adsorption.

An example of image forming apparatus to which the magnetic developer of the present invention may be suitably applied is described with reference to FIG. 1.

An OPC photosensitive member 3 surface is negatively charged by a primary charger 11, subjected to image-scanning with laser light 5 to form a digital latent image, and the resultant latent image is reversely developed with a monocomponent magnetic developer 13 comprising a magnetic toner in a developing apparatus 1 which comprises a developing sleeve 6 equipped with an elastic blade 9 of urethane rubber disposed counterwise and enclosing a magnet 5. In the developing zone, an alternating bias, pulse bias and/or DC bias is applied between the conductive substrate of the photosensitive drum 3 and the developing sleeve 6 by a bias voltage application means 12. When a transfer paper P is conveyed to a transfer zone, the paper is charged from the back side (opposite side with respect to the photosensitive drum) by an electrostatic transfer means 4, whereby the developed image (toner image) on the photosensitive drum is electrostatically transferred to the transfer paper P. Then, the transfer paper P is separated from the photosensitive drum 3 and subjected to fixation by means of a hot pressing roller fixer 7 for fixing the toner image on the transfer paper P.

Residual monocomponent developer remaining on the photosensitive drum after the transfer step is removed by a cleaner 14 having a cleaning blade 8. The photosensitive drum 3 after the cleaning is subjected to erase-exposure for discharge and then subjected to a repeating cycle commencing from the charging step by the primary charger 11.

The electrostatic image-bearing member (photosensitive drum) comprises a photosensitive layer and a conductive substrate and rotates in the direction of the arrow. The developing sleeve 6 comprising a non-magnetic cylinder as a toner-carrying member rotates so as to move in the same direction as the electrostatic image holding member surface at the developing zone. Inside the non-magnetic cylinder sleeve 6, a multi-pole permanent magnet 15 (magnet roll) as a magnetic field generating means is disposed so as not to rotate. The monocomponent insulating magnetic developer 13 in the developing apparatus is applied onto the non-magnetic cylinder sleeve 6 and the toner particles are provided with, e.g., a negative triboelectric charge due to friction between the sleeve 6 surface and the toner particles. Further, by disposing the elastic blade 9, the thickness of the developer layer is regulated at a thin and uniform thickness (30–300μ) which is thinner than the spacing between the photosensitive drum 3 and the developing sleeve 6 so that the developer layer does not contact the photosensitive drum 3. The rotation speed of the sleeve 6 is so adjusted that the circumferential velocity of the sleeve 6 is substantially equal to or close to that of the photosensitive drum surface. In the developing zone, an AC bias or a pulsed bias may be applied between the sleeve 6 and the photosensitive drum 3 by the biasing means 12. The AC bias may preferably comprise f=200–4000 Hz and Vpp=500–3000 V.

In the developing zone, the toner particles are transferred to the electrostatic image under the action of an electrostatic force exerted by the electrostatic image bearing surface of the photosensitive drum 3 and the AC bias or pulsed bias.

Hereinbelow, the present invention will be described more specifically based on Examples.

Synthesis Example 1 (resin)

| | |
|---|---|
| Styrene | 82 wt. part(s) |
| Butyl acrylate | 18 wt. part(s) |
| Monobutyl maleate | 0.5 wt. part(s) |
| Di-tert-butyl peroxide | 2 wt. part(s) |

The above monomer composition was mixed with 200 wt. parts of xylene heated to the refluxing temperature, and the solution polymerization was completed within 6 hours under xylene reflux to obtain a solution of low-temperature softening resin.

On the other hand, the following monomer composition was mixed and dispersed in suspension within 200 wt. parts of degassed water containing 0.2 wt. part of polyvinyl alcohol.

| | |
|---|---|
| Styrene | 68 wt. part(s) |
| Butyl acrylate | 26 wt. part(s) |
| Monobutyl maleate | 6 wt. part(s) |
| Benzoyl peroxide | 0.1 wt. part(s) |

The resultant suspension liquid was held at 80° C. under nitrogen atmosphere for 24 hours to complete polymerization, followed by de-watering and drying to obtain a high-temperature softening resin.

23 wt. parts of the high-temperature softening resin was added to the solution containing 77 wt. parts of the low-temperature softening resin just after the polymerization for complete mixing and dissolution, followed by vacuum distillation at a high temperature (180° C.) to obtain an objective styrene-based copolymer composition.

The resin showed a viscosity of $8.8\times10^3$ poise at 150° C.

Synthesis Example 2 (resin)

| | |
|---|---|
| Styrene | 95 wt. parts |
| Butyl acrylate | 5 wt. parts |
| Lauroyl peroxide | 4 wt. parts |

The above monomer composition was dissolved and mixed within 400 wt. parts of toluene at room temperature. Then, the toluene mixture solution was heated to 85° C. under stirring, followed by 10 hours of polymerization to complete the reaction and distilling-off of the toluene to obtain an objective low-temperature softening resin.

67 wt. parts of the low-temperature softening resin was dissolved in the following monomer composition to form a mixture solution.

| | |
|---|---|
| Styrene | 60 wt. part(s) |
| Butyl acrylate | 40 wt. part(s) |
| Monobutyl maleate | 5 wt. part(s) |
| Divinylbenzene | 0.4 wt. part(s) |
| Benzoyl peroxide | 1.2 wt. part(s) |

Into the above mixture solution, 250 wt. parts of degassed water containing 0.1 wt. part of partially saponified polyvinyl alcohol to form a suspension liquid. Into a reaction vessel containing 15 wt. parts of water and aerated with nitrogen, the above suspension liquid was added and subjected to 10 hours of suspension polymerization at 80° C. After the reaction, the product was subjected to steam distillation, separated by filtration, sufficiently dewatered and dried to obtain an objective styrene copolymer composition, which showed a viscosity of $3.8\times10^5$ poise at 150° C.

Comparative Synthesis Example 1 (resin)

The high-temperature softening resin and low-temperature softening resin in Synthesis Example 1 in amounts of 90 wt. parts and 10 wt. parts, respectively, were mixed with each other to obtain a styrene-based copolymer composition, which showed a viscosity of $7.2\times10^6$ poise at 150° C.

Production Example 1 (magnetic material)

Commercially available spherical magnetite ($\phi$=0.92) having a BET specific surface area of 6.5 $m^2/g$ and 0.8 wt. % thereof of silica fine powder having a BET specific surface area of 380 $m^2/g$ were blended with each other by Mix-mailer to secure the silica fine powder to the magnetite surface, thus obtaining magnetic material No. 1. The physical properties, etc., of magnetic material No. 1 are summarized in Table 1 appearing hereinafter.

The specific surface area of the spherical magnetite obtained by microscopic observation and calculation based on the above-mentioned equation was also 6.5 $m^2/g$ and showed a good agreement with the BET specific surface area thereof measured by nitrogen adsorption.

30 g of magnetic material No. 1 was placed in an Erlenmeyer flask and sufficiently stirred together with 200 cc of water and a small amount of surfactant, followed by 3 min. of ultrasonic washing. Then, the washing liquid was discarded while preventing the flow out of the magnetic material by using a magnet. Then, the magnetic material was subjected to two times of washing each with 200 cc of water under sufficient stirring followed by dicarding of the washing water. The magnetic material No. 1 was then subjected to quantitative analysis of surface silica by fluorescent X-ray analysis. As a result, 99% of the silica compared with that before the washing was detected, whereby it was confirmed that the silica fine powder was secured to the magnetite surface.

Production Example 2 (magnetic material)

Magnetic material No. 2 was prepared in the same manner as in Production Example 1 except that 1.8 wt. % of silica fine powder having a BET specific surface area of 150 $m^2/g$ was added, and the blending intensity was somewhat weakened. The physical properties, etc., of magnetic material No. 2 are also shown in Table 1.

Magnetic material No. 2 was washed and subjected to fluorescent X-ray analysis in the same manner as in Production Example 1, whereby at least 95% of silica compared with that before the washing was detected, thus showing the securing of the silica to the magnetite surface.

Production Example 3 (magnetic material)

Magnetic material No. 3 was prepared in the same manner as in Production Example 1 except that commercially available spherical magnetite ($\phi=0.89$) having a BET specific surface area of 5.3 $m^2/g$ was blended with 0.8 wt. % thereof of silica fine powder having a BET specific surface area of 200 $m^2/g$. The physical properties, etc., of magnetic material No. 3 are also shown in Table 1.

Magnetic material No. 3 was washed and subjected to fluorescent X-ray analysis in the same manner as in Production Example 1, whereby at least 95% of silica compared with that before the washing was detected, thus showing the securing of the silica to the magnetite surface.

Production Example 4 (magnetic material)

Magnetic material No. 4 was prepared in the same manner as in Production Example 3 except that 2.2 wt. % of the silica fine powder used in Production Example 2 was blended with the magnetite by means of a ball mill. The physical properties, etc., of magnetic material No. 4 are also shown in Table 1.

Magnetic material No. 4 was washed and subjected to fluorescent X-ray analysis in the same manner as in Production Example 1, whereby at least 95% of silica compared with that before the washing was detected, thus showing the securing of the silica to the magnetite surface.

Production Example 5 (magnetic material)

Magnetic material No. 5 was prepared in the same manner as in Production Example 1 except that 0.4 wt. % of the silica fine powder used in Production Example 2 was blended with the magnetite by means of a ball mill. The physical properties, etc., of magnetic material No. 5 are also shown in Table 1.

Magnetic material No. 5 was washed and subjected to fluorescent X-ray analysis in the same manner as in Production Example 1, whereby at least 95% of silica compared with that before the washing was detected, thus showing the securing of the silica to the magnetite surface.

Production Example 6 (magnetic material)

Magnetic material No. 6 was prepared in the same manner as in Production Example 5 except that 1.4 wt. % of alumina fine powder having a BET specific surface area of 120 $m^2/g$ was blended with the magnetite. The physical properties, etc., of magnetic material No. 6 are also shown in Table 1.

Magnetic material No. 6 was washed and subjected to fluorescent X-ray analysis in the same manner as in Production Example 1, whereby at least 95% of alumina compared with that before the washing was detected, thus showing the securing of the alumina to the magnetite surface.

Comparative Production Example 1 (magnetic material)

The commercially available spherical magnetite ($\phi=0.92$) having a BET specific surface area of 6.5 $m^2/g$ used in Production Example 1 was used as comparative magnetic material o. 1. The physical properties, etc., thereof are also shown in Table 1.

Comparative Production Example 2 (magnetic material)

Comparative magnetic material No. 2 was prepared in the same manner as in Production Example 5 except that 6.5 wt. % of the silica fine powder was blended with the magnetite by means of a ball mill. The physical properties, etc., thereof are also shown in Table 1.

Comparative Production Example 3 (magnetic material)

0.8 wt. % of the silica fine powder used in Production Example 3 was blended with the magnetite used in Production Example 1 very weakly by means of a Henschel mixer to obtain comparative magnetic material No. 3. The physical properties, etc., thereof are also shown in Table 1.

As shown in Table 1, comparative magnetic material No. 3 showed a ratio $B/(0.01\times C\times D)$ (representing a ratio of the actual increase in BET specific surface area to the theoretical increase in BET specific surface area due to the silica fine powder affixing treatment) which was as low as 0.38. This means that a very small proportion of the added silica was present at the surface of the magnetite, and the remainder was present in an isolated form without being affixed to the magnetite surface.

Comparative magnetic material No. 3 was washed and subjected to fluorescent X-ray analysis in the same manner as in Production Example 1, whereby only 60% of silica compared with that before the washing was detected, thus showing the isolation of silica due to the washing. As described above, this result also indicates that the silica was not secured to the magnetite surface.

Comparative Production Example 4 (magnetic material)

Comparative magnetic material No. 4 was prepared in the same manner as in Production Example 2 except that the blending was performed very strongly by means of a ball mill. The physical properties, etc., thereof are also shown in Table 1.

As shown in Table 1, comparative magnetic material No. 4 showed a very high $B/(0.01\times C\times D)$ ratio of 2.56 which means that the magnetite and/or silica was pulverized into finer powder.

TABLE 1

| Magnetic material | Inorganic fine particles | A ($m^2/g$) | $\phi$ | B ($m^2/g$) | C (wt. %) | 30 × C | D ($m^2/g$) | B/A | B/(0.01 × C × D) | Blend intensity* | Blender |
|---|---|---|---|---|---|---|---|---|---|---|---|
| No. 1 | silica | 6.5 | 0.92 | 3.2 | 0.8 | 24 | 380 | 0.49 | 1.05 | medium | Mix-maller |
| No. 2 | silica | 6.5 | 0.92 | 2.8 | 1.8 | 54 | 150 | 0.43 | 1.04 | slightly weak | Mix-maller |
| No. 3 | silica | 5.3 | 0.89 | 1.9 | 0.8 | 24 | 200 | 0.35 | 1.19 | medium | Mix-maller |
| No. 4 | silica | 5.3 | 0.89 | 3.6 | 2.2 | 66 | 150 | 0.68 | 1.09 | medium | ball mill |
| No. 5 | silica | 6.5 | 0.92 | 0.8 | 0.4 | 12 | 150 | 0.12 | 1.33 | medium | ball mill |

TABLE 1-continued

| Magnetic material | Inorganic fine particles | A ($m^2/g$) | $\phi$ | B ($m^2/g$) | C (wt. %) | 30 × C | D ($m^2/g$) | B/A | B/(0.01 × C × D) | Blend intensity* | Blender |
|---|---|---|---|---|---|---|---|---|---|---|---|
| No. 6 | alumina | 6.5 | 0.92 | 1.2 | 1.4 | 42 | 120 | 0.18 | 0.71 | medium | ball mill |
| Comparative | | | | | | | | | | | |
| No. 1 | none | 6.5 | 0.92 | — | — | — | — | — | — | — | — |
| No. 2 | silica | 6.5 | 0.92 | 9.0 | 6.5 | 195 | 150 | 1.38 | 0.92 | medium | ball mill |
| No. 3 | silica | 6.5 | 0.92 | 0.6 | 0.8 | 24 | 200 | 0.09 | 0.38 | very weak | Henschel |
| No. 4 | silica | 6.5 | 0.92 | 6.9 | 1.8 | 54 | 150 | 1.06 | 2.56 | very strong | ball mill |

A: specific surface area of magnetic material
B: increase in specific surface area of magnetic material after blending with inorganic fine particles
C: amount of inorganic fine particles added
D: specific surface area of inorganic fine particles
*: The blend intensity was indicated relatively in comparison with that in Production Example 1.

EXAMPLE 1

| | |
|---|---|
| Magnetic material of Production Example 1 | 100 wt. part(s) |
| Resin of Synthesis Example 1 | 100 wt. part(s) |
| Negative charge control agent (Cr complex of azo dye) | 0.6 wt. part(s) |
| Low-molecular weight polypropylene | 4 wt. part(s) |

A blend of the above ingredients was melt-kneaded at 130° C. by means of a twin-screw extruder. The kneaded product was cooled, coarsely crushed by a hammer mill and finely pulverized by a pneumatic classifier to obtain a magnetic toner having a weight-average particle size (diameter) of 6.5 μm.

100 wt. parts of the magnetic toner was blended with 1.2 wt. parts of silica fine powder surface-treated with silane coupling agent and silicone oil to obtain a magnetic developer.

Separately, a commercially available laser beam printer ("LBP-8II", mfd. by Canon K. K.) was re-modeled with respect to its apparatus unit (toner cartridge) into one as shown in FIG. 1, wherein a urethane rubber-made elastic blade (9) was abutted to an aluminum developing sleeve at an abutting pressure of 30 g/cm.

Then, the above-prepared magnetic developer was incorporated in the re-modeled laser beam printer and used for image formation in the following manner. An OPC photosensitive drum was primarily charged at −570 V, and an electrostatic latent image for reversal development was formed thereon. The developer was formed in a layer on a developing sleeve 6 (containing magnet) so as to form a clearance (300 μm) from the photosensitive drum at the developing position. An AC bias (f=1,800 Hz and Vpp=1,200 V) and a DC bias ($V_{DC}$=−420 V) were applied to the sleeve, and an electrostatic image formed on the photosensitive drum was developed by the reversal development mode, to form a magnetic toner image on the OPC photosensitive drum. The thus-formed toner image was transferred to plain paper under application of a positive transfer voltage, and then fixed to the plain paper by passing through a hot-pressure roller fixer at 150° C. at a fixing speed of 24 mm/sec (equivalent to that in "LBP-A404"; corresponding to four A4-sheets/min).

In this way, a successive printing test was performed up to 4000 sheets while replenishing the developer, as required, under the conditions of normal temperature—normal humidity (23° C.-60% RH), high temperature—high humidity (32° C.-85% RH) and low temperature—low humidity (15° C.-10% RH), respectively.

The images were evaluated with respect to an image density as measured by a MacBeth reflection densitometer, and image qualities, such as transfer dropout, by eye observation.

Further, an image on paper was rubbed with soft tissue paper under a load of 50 g/cm$^2$ for 5 reciprocations at a specific point, and the fixability thereof was evaluated by a density decrease due to the rubbing according to the following equation:

Density decrease (%)=[(density before rubbing—density after rubbing)/(density before rubbing)]×100

The anti-offset characteristic was evaluated by eye observation of dirt on image.

The photosensitive member (drum) after the 4000 sheets of printing test was evaluated with respect to surface damage and toner sticking caused thereby.

The results are shown in Tables 3 and 4 appearing hereinafter together with the following Examples and Comparative Examples.

EXAMPLE 2

| | |
|---|---|
| Magnetic material of Production Example 1 | 80 wt. part(s) |
| Resin of Synthesis Example 1 | 100 wt. part(s) |
| Negative charge control agent (Cr complex of alkylsalicylic acid) | 0.6 wt. part(s) |
| Low-molecular weight polypropylene | 4 wt. part(s) |

A blend of the above ingredients was melt-kneaded, pulverized and classified in the same manner as in Example 1 to obtain a magnetic toner having a weight-average particle size of 8.5 μm.

100 wt. parts of the magnetic toner was blended with 0.6 wt. % of the surface-treated silica to obtain a magnetic developer.

The magnetic developer was subjected to the printing test and evaluation in the same manner as in Example 1.

EXAMPLES 3-10

Magnetic developers were prepared in the same manner as in Example 1 except that magnetic materials and external additive particles were respectively replaced by those shown in Table 2, and subjected to the printing test and evaluation in the same manner as in Example 1.

EXAMPLE 11

A magnetic developer was prepared in the same manner as in Example 1 except that the resin was replaced by one of Synthesis Example 2, and subjected to the printing test and evaluation in the same manner as in Example 1.

Comparative Example 1

A magnetic developer was prepared in the same manner as in Example 1 except that the magnetic material was replaced by comparative magnetic material No. 1, and subjected to the printing test and evaluation in the same manner as in Example 1.

Comparative Examples 2–4

Magnetic developers were prepared in the same manner as in Example 1 except that magnetic materials and external additive particles were respectively replaced by those shown in Table 3, and subjected to the printing test and evaluation in the same manner as in Example 1.

Comparative Example 5

A magnetic developer was prepared in the same manner as in Example 1 except that the resin was replaced by one of Comparative Synthesis Example 1, and subjected to the printing test and evaluation in the same manner as in Example 1.

The results of the evaluation are summarized in the following Tables 2 and 3, wherein the evaluation standards for the respective items are as follows.

[Fixability]

∘: very good, at most 5%
o: good, 5–10%
Δ: practically acceptable, 10–20%
x: not acceptable, at least 20%

[Anti-offset characteristic]

∘: very good, utterly no offset
o: good, almost no offset
Δ: practically acceptable
x: not acceptable

[Image density]

∘: very good, at least 1.40
o: good, 1.35–1.40
Δ: practically acceptable, 1.00–1.35
x: not acceptable, at most 1.00

[Transfer failure]

∘: very good, no abnormality at all
o: good, very slight transfer failure
Δ: transfer failure observed but practically acceptable
x: much transfer failure, and considerable images accompanied with lacks

[Photosensitive member (drum) surface]

∘: very good, no abnormality at all
o: very slightly damaged but no abnormality in image
Δ: damaged and results in image defects which are however practically acceptable
x: toner sticks at damages and results in many lacks in images

TABLE 2

| Example No. | Magnetic material | External additive: silica 1: specific surface area 2: addition rate 3: treating agent | Anti-offset NT-NH | Fixability NT-NH | Image density NT-NH | Image density HT-HH | Image density LT-LH | Transfer failure NT-NH | Drum surface NT-NH |
|---|---|---|---|---|---|---|---|---|---|
| Ex. 1 | No. 1 | 1: 150 ($m^2/g$)<br>2: 1.2%<br>3: silane coupler + silicone oil | ◎ | ◎ | ◎ | ◎ | ◎ | ◎ | ◎ |
| Ex. 2 | No. 1 | 1, 3: Same as in Ex. 1<br>2: 0.8% | ◎ | ◎ | ◎ | ◎ | ◎ | ◎ | ◎ |
| Ex. 3 | No. 2 | 1, 3: Same as in Ex. 1<br>2: 1.2% | ◎ | ◎ | ◎ | ◎ | ◎ | ◎ | ◎ |
| Ex. 4 | No. 3 | Same as in Ex. 1 | ∘ | ◎ | ◎ | ◎ | ◎ | ◎ | ◎ |
| Ex. 5 | No. 4 | Same as in Ex. 1 | ◎ | Δ | ∘ | ∘ | ◎ | ◎ | ◎ |
| Ex. 6 | No. 5 | Same as in Ex. 1 | Δ | ◎ | ∘ | ∘ | ∘ | Δ | ◎ |
| Ex. 7 | No. 6 | Same as in Ex. 1 | Δ | ◎ | ∘ | Δ | ∘ | Δ | ◎ |
| Ex. 8 | No. 1 | 1: 200 ($m^2/g$)<br>2: 1.2%<br>3: none | ◎ | ◎ | ∘ | Δ | ◎ | Δ | Δ |
| Ex. 9 | No. 1 | 1, 3: Same as in Ex. 1<br>2: 2.5% | ◎ | ∘ | ∘ | ◎ | Δ | ◎ | Δ |
| Ex. 10 | No. 1 | 1: 80 ($m^2/g$)<br>2: 1.2%<br>3: silane coupler | ∘ | ◎ | ∘ | Δ | ∘ | Δ | Δ |
| Ex. 11 | No. 1 | Same as in Ex. 1 | ◎ | Δ | ∘ | ∘ | ∘ | ◎ | ◎ |

NT-NH = normal temperature - normal humidity (23° C. - 60% RH)
HT-HH = high temperature - high humidity (32.5° C. - 85% RH)
LT-LH = low temperature - low humidity (15° C. - 10% RH)

TABLE 3

| Comparative Example No. | Magnetic material | External additive: silica | Anti-offset NT-NH | Fixability NT-NH | Image density NT-NH | Image density HT-HH | Image density LT-LH | Transfer failure NT-NH | Drum surface NT-NH |
|---|---|---|---|---|---|---|---|---|---|
| Comp. Ex. 1 | Comparative No. 1 | Same as in Ex. 1 | x | ◎ | ∘ | ∘ | Δ | ∘ | ∘ |
| Comp. Ex. 2 | Comparative No. 2 | Same as in Ex. 1 | ◎ | x | Δ | x | ∘ | ◎ | x |
| Comp. Ex. 3 | Comparative No. 3 | Same as in Ex. 1 | x | ◎ | ∘ | ∘ | Δ | ∘ | ∘ |
| Comp. Ex. 4 | Comparative No. 4 | Same as in Ex. 1 | ◎ | x | x | x | Δ | Δ | x |
| Comp. Ex. 5 | No. 1 | Same as in | ◎ | x | ◎ | ◎ | ∘ | ◎ | ∘ |

TABLE 3-continued

| Comparative Example No. | Magnetic material | External additive: silica | Anti-offset NT-NH | Fixability NT-NH | Image density NT-NH | Image density HT-HH | Image density LT-LH | Transfer failure NT-NH | Drum surface NT-NH |
|---|---|---|---|---|---|---|---|---|---|
| | | Ex. 1 | | | | | | | |

Synthesis Example 3 (resin)

| | |
|---|---|
| Styrene | 81 wt. part(s) |
| Butyl acrylate | 19 wt. part(s) |
| Monobutyl maleate | 0.5 wt. part(s) |
| Di-tert-butyl peroxide | 2 wt. part(s) |

The above monomer composition was mixed with 200 wt. parts of xylene heated to the refluxing temperature, and the solution polymerization was completed within 6 hours under xylene reflux to obtain a solution of low-temperature softening resin.

On the other hand, the following monomer composition was mixed and dispersed in suspension within 200 wt. parts of degassed water containing 0.2 wt. part of polyvinyl alcohol.

| | |
|---|---|
| Styrene | 65 wt. part(s) |
| Butyl acrylate | 30 wt. part(s) |
| Monobutyl maleate | 5 wt. part(s) |
| Benzoyl peroxide | 0.1 wt. part(s) |

The resultant suspension liquid was held at 78° C. under nitrogen atmosphere for 24 hours to complete polymerization, followed by de-watering and drying to obtain a high-temperature softening resin.

25 wt. parts of the high-temperature softening resin was added to the solution containing 75 wt. parts of the low-temperature softening resin just after the polymerization for complete mixing and dissolution, followed by vacuum distillation at a high temperature (180° C.) to obtain an objective styrene-based copolymer composition.

The resin showed a viscosity of $9.8\times10^3$ poise at 150° C.

Synthesis Example 4 (resin)

| | |
|---|---|
| Styrene | 92 wt. parts |
| Butyl acrylate | 8 wt. parts |
| Lauroyl peroxide | 4 wt. parts |

The above monomer composition was dissolved and mixed within 400 wt. parts of toluene at room temperature. Then, the toluene mixture solution was heated to 85° C. under stirring, followed by 10 hours of polymerization to complete the reaction and distilling-off of the toluene to obtain an objective low-temperature softening resin.

67 wt. parts of the low-temperature softening resin was dissolved in the following monomer composition to form a mixture solution.

| | |
|---|---|
| Styrene | 57 wt. part(s) |
| Butyl acrylate | 43 wt. part(s) |
| Monobutyl maleate | 5 wt. part(s) |
| Divinylbenzene | 0.4 wt. part(s) |
| Benzoyl peroxide | 1.2 wt. part(s) |

Into the above mixture solution, 250 wt, parts of degassed water containing 0.1 wt. part of partially saponified polyvinyl alcohol to form a suspension liquid. Into a reaction vessel containing 15 wt. parts of water and aerated with nitrogen, the above suspension liquid was added and subjected to 10 hours of suspension polymerization. After the reaction, the product was subjected to steam distillation, separated by filtration, sufficiently dewatered and dried to obtain an objective styrene copolymer composition, which showed a viscosity of $3.7\times10^5$ poise at 150° C.

Comparative Synthesis Example 2 (resin)

The high-temperature softening resin and low-temperature softening resin in Synthesis Example 1 in amounts of 88 wt. parts and 17 wt. parts, respectively, were mixed with each other to obtain a styrene-based copolymer composition, which showed a viscosity of $7.0\times10^6$ poise at 150° C.

Production Example 7 (magnetic material)

Commercially available spherical magnetite ($\phi$=0.92) having a BET specific surface area of 6.6 $m^2/g$ and 0.8 wt. % thereof of surface-treated silica fine powder having a hydrophobicity of 72% and a BET specific surface area of 280 $m^2/g$ were blended with each other by Mix-mailer to secure the silica fine powder to the magnetite surface, thus obtaining magnetic material No. 7. The physical properties, etc., of magnetic material No. 7 are summarized in Table 4 appearing hereinafter.

30 g of magnetic material No. 7 was placed in an Erlenmeyer flask and sufficiently stirred together with 200 cc of methanol and a small amount of surfactant, followed by 3 min. of ultrasonic washing. Then, the washing liquid was discarded while preventing the flow out of the magnetic material by using a magnet. Then, the magnetic material was subjected to two times of washing each with 200 cc of methanol under sufficient stirring followed by dicarding of the washing methanol. The magnetic material No. 7 was then subjected to quantitative analysis of surface silica by fluorescent X-ray analysis. As a result, at least 95% of the silica compared with that before the washing was detected, whereby it was confirmed that the silica fine powder was secured to the magnetite surface.

Production Example 8 (magnetic material)

Magnetic material No. 8 was prepared in the same manner as in Production Example 7 except that 2.0 wt. % of surface-treated silica fine powder having hydrophobicity of 68% and a BET specific surface area of 80 $m^2/g$ was added, and the blending intensity was somewhat weakened. The physical properties, etc., of magnetic material No. 8 are also shown in Table 4.

Magnetic material No. 8 was washed and subjected to fluorescent X-ray analysis in the same manner as in Production Example 7, whereby at least 95% of silica compared with that before the washing was detected, thus showing the securing of the silica to the magnetite surface.

Production Example 9 (magnetic material)

Magnetic material No. 9 was prepared in the same manner as in Production Example 7 except that commercially available spherical magnetite ($\phi=0.90$) having a BET specific surface area of 5.0 $m^2/g$ was blended with 0.8 wt. % thereof of surface-treated silica fine powder having a hydrophobicity of 67% and a BET specific surface area of 170 $m^2/g$. The physical properties, etc., of magnetic material No. 9 are also shown in Table 4.

Magnetic material No. 9 was washed and subjected to fluorescent X-ray analysis in the same manner as in Production Example 7, whereby at least 95% of silica compared with that before the washing was detected, thus showing the securing of the silica to the magnetite surface.

Production Example 10 (magnetic material)

Magnetic material No. 10 was prepared in the same manner as in Production Example 9 except that 1.2 wt. % of the silica fine powder used in Production Example 7 was blended with the magnetite by means of a ball mill. The physical properties, etc., of magnetic material No. 10 are also shown in Table 4.

Magnetic material No. 10 was washed and subjected to fluorescent X-ray analysis in the same manner as in Production Example 7, whereby at least 95% of silica compared with that before the washing was detected, thus showing the securing of the silica to the magnetite surface.

Production Example 11 (magnetic material)

Magnetic material No. 11 was prepared in the same manner as in Production Example 7 except that 2.0 wt. % of surface-treated alumina fine powder having a hydrophobicity of 55% and a BET specific surface area of 90 $m^2/g$ was blended with the magnetite by means of a ball mill. The physical properties, etc., of magnetic material No. 11 are also shown in Table 4.

Magnetic material No. 11 was washed and subjected to fluorescent X-ray analysis in the same manner as in Production Example 7, whereby at least 95% of alumina compared with that before the washing was detected, thus showing the securing of the alumina to the magnetite surface.

Production Example 12 (magnetic material)

Magnetic material No. 12 was prepared in the same manner as in Production Example 7 except that 0.8 wt. % of surface-treated silica fine powder having a hydrophobicity of 38% and a BET specific surface area of 310 $m^2/g$ was blended with the magnetite. The physical properties, etc., of magnetic material No. 12 are also shown in Table 4.

Magnetic material No. 12 was washed and subjected to fluorescent X-ray analysis in the same manner as in Production Example 7, whereby at least 95% of silica compared with that before the washing was detected, thus showing the securing of the silica to the magnetite surface.

Comparative Production Example 5 (magnetic material)

The commercially available spherical magnetite ($\phi=0.92$) having a BET specific surface area of 6.6 $m^2/g$ used in Production Example 7 was used as comparative magnetic material No. 5. The physical properties, etc., thereof are also shown in Table 4.

Comparative Production Example 6 (magnetic material)

Comparative magnetic material No. 6 was prepared in the same manner as in Production Example 7 except that 4.0 wt. % of the silica fine powder was blended. The physical properties, etc., thereof are also shown in Table 4.

Comparative Production Example 7 (magnetic material)

Comparative magnetic material No. 7 was prepared in the same manner as in Production Example 7 except that 0.6 wt. % of the silica fine powder used in Production Example 8 was blended with the magnetite. The physical properties, etc., thereof are also shown in Table 4.

Comparative Production Example 8 (magnetic material)

comparative magnetic material No. 8 was prepared in the same manner as in Production Example 8 except that the blending was performed very strongly by means of a ball mill. The physical properties, etc., thereof are also shown in Table 4.

As shown in Table 4, comparative magnetic material No. 8 showed a ratio $B/(0.01\times C\times D)$ (representing a ratio of the actual increase in BET specific surface area to the theoretical increase in BET specific surface area due to the silica fine powder affixing treatment) which was as high as 3.44. This means that the magnetite and/or silica was pulverized into finer powder.

Comparative Production Example 9 (magnetic material)

Comparative magnetic material No. 9 was prepared in the same manner as in Production Example 7 except that the silica and the magnetite were blended very weakly by means of a Henschel mixer. The physical properties, etc., thereof are also shown in Table 4.

As shown in Table 4, comparative magnetic material No. 9 showed a very low $B/(0.01\times C\times D)$ ratio of 0.26. This means that a very small proportion of the added silica was present at the surface of the magnetite, and the remainder was present in an isolated form without being affixed to the magnetite surface.

Comparative magnetic material No. 9 was washed and subjected to fluorescent X-ray analysis in the same manner as in Production Example 7, whereby only 60% of silica compared with that before the washing was detected, thus showing the isolation of silica due to the washing. As described above, this result also indicates that the silica was not secured to the magnetite surface.

TABLE 4

| Magnetic material | Inorganic fine particles Species | Hydro-phobicity | A ($m^2/g$) | $\phi$ | B ($m^2/g$) | (wt. %) | 30 × C | D ($m^2/g$) | B/A | B/(0.01 × C × D) | Blend intensity* | Blender |
|---|---|---|---|---|---|---|---|---|---|---|---|---|
| No. 7 | silica | 72% | 6.6 | 0.92 | 2.1 | 0.8 | 24 | 280 | 0.32 | 0.94 | medium | Mix-maller |
| No. 8 | silica | 68% | 6.6 | 0.92 | 1.9 | 2.0 | 60 | 80 | 0.29 | 1.19 | slightly weak | Mix-maller |
| No. 9 | silica | 67% | 5.0 | 0.90 | 1.5 | 0.8 | 24 | 170 | 0.30 | 1.10 | medium | Mix-maller |
| No. 10 | silica | 72% | 5.0 | 0.90 | 3.8 | 1.2 | 36 | 280 | 0.76 | 1.13 | medium | ball mill |
| No. 11 | alumina | 55% | 6.6 | 0.92 | 1.7 | 2.0 | 60 | 90 | 0.25 | 0.94 | medium | ball mill |
| No. 12 | silica | 38% | 6.6 | 0.92 | 2.3 | 0.8 | 24 | 310 | 0.35 | 0.93 | medium | Mix-maller |
| Comparative | | | | | | | | | | | | |
| No. 5 | none | — | 6.6 | 0.92 | — | — | — | — | — | — | — | — |
| No. 6 | silica | 72% | 6.6 | 0.92 | 9.8 | 4.0 | 120 | 280 | 1.48 | 0.88 | medium | Mix-maller |
| No. 7 | silica | 68% | 6.6 | 0.92 | 0.4 | 0.6 | 18 | 80 | 0.06 | 0.83 | medium | Mix-maller |
| No. 8 | silica | 68% | 6.6 | 0.92 | 5.5 | 2.0 | 60 | 80 | 0.83 | 3.44 | very strong | ball mill |
| No. 9 | silica | 72% | 6.6 | 0.92 | 0.6 | 0.8 | 24 | 280 | 0.09 | 0.27 | very weak | Henschel |

A: specific surface area of magnetic material
B: increase in specific surface area of magnetic material after blending with inorganic fine particles
C: amount of inorganic fine particles added
D: specific surface area of inorganic fine particles
*: The blend intensity was indicated relatively in comparison with that in Production Example 7.

EXAMPLE 12

| | |
|---|---|
| Magnetic material No. 7 | 100 wt. part(s) |
| Resin of Synthesis Example 3 | 100 wt. part(s) |
| Negative charge control agent (Cr complex of azo dye) | 0.6 wt. part(s) |
| Low-molecular weight polypropylene | 4 wt. part(s) |

A blend of the above ingredients was melt-kneaded at 130° C. by means of a twin-screw extruder. The kneaded product was cooled, coarsely crushed by a hammer mill and finely pulverized by a pneumatic classifier to obtain a magnetic toner having a weight-average particle size (diameter) of 6.6 μm.

100 wt. parts of the magnetic toner was blended with 1.0 wt. part of silica fine powder to obtain a magnetic developer.

The magnetic developer was subjected to the printing test and evaluation in the same manner as in Example 1.

The results are shown in Table 5 appearing hereinafter together with the following Examples and Comparative Examples.

EXAMPLE 13

| | |
|---|---|
| Magnetic material No. 7 | 80 wt. part(s) |
| Resin of Synthesis Example 1 | 100 wt. part(s) |
| Negative charge control agent (Cr complex of alkylsalicylic acid) | 1 wt. part(s) |
| Low-molecular weight polypropylene | 4 wt. part(s) |

A blend of the above ingredients was melt-kneaded, pulverized and classified in the same manner as in Example 12 to obtain a magnetic toner having a weight-average particle size of 8.8 μm.

100 wt. parts of the magnetic toner was blended with 0.6 wt. % of silica fine powder to obtain a magnetic developer.

The magnetic developer was subjected to the printing test and evaluation in the same manner as in Example 12.

EXAMPLES 14–18

Magnetic developers were prepared in the same manner as in Example 12 except that the magnetic material No. 7 was replaced by magnetic materials No. 8–12, respectively, and subjected to the printing test and evaluation in the same manner as in Example 12.

EXAMPLE 19

A magnetic developer was prepared in the same manner as in Example 12 except that the resin was replaced by one of Synthesis Example 4, and subjected to the printing test and evaluation in the same manner as in Example 12.

Comparative Example 6

A magnetic developer was prepared in the same manner as in Example 12 except that the magnetic material was replaced by comparative magnetic material No. 5, and subjected to the printing test and evaluation in the same manner as in Example 12.

Comparative Examples 7–10

Magnetic developers were prepared in the same manner as in Example 12 except that the magnetic material was replaced by comparative magnetic material Nos. 6–9, and subjected to the printing test and evaluation in the same manner as in Example 12.

Comparative Example 12

A magnetic developer was prepared in the same manner as in Example 12 except that the resin was replaced by one of Comparative Synthesis Example 2, and subjected to the printing test and evaluation in the same manner as in Example 12.

The results of the evaluation are summarized in the following Table 5, wherein the evaluation standards for the respective items are the same as in Tables 2 and 3.

TABLE 5

| Example No. | Magnetic material | Anti-offset NT-NH | Fixability NT-NH | Image density NT-NH | Image density HT-HH | Image density LT-LH | Transfer failure NT-NH | Drum surface NT-NH |
|---|---|---|---|---|---|---|---|---|
| Ex. 12 | No. 7 | ◎ | ◎ | ◎ | ◎ | ◎ | ◎ | ◎ |

TABLE 5-continued

| Example No. | Magnetic material | Anti-offset NT-NH | Fixability NT-NH | Image density NT-NH | Image density HT-HH | Image density LT-LH | Transfer failure NT-NH | Drum surface NT-NH |
|---|---|---|---|---|---|---|---|---|
| Ex. 13 | No. 7 | ◎ | ◎ | ◎ | ◎ | ◎ | ◎ | ◎ |
| Ex. 14 | No. 8 | ◎ | ◎ | ◎ | ◎ | ◎ | ◎ | ◎ |
| Ex. 15 | No. 9 | ◎ | ◎ | ◎ | ◎ | ◎ | ◎ | ◎ |
| Ex. 16 | No. 10 | ◎ | Δ | ◎ | ○ | ◎ | ◎ | ◎ |
| Ex. 17 | No. 11 | ○ | ○ | ○ | Δ | ○ | ○ | ○ |
| Ex. 18 | No. 12 | ○ | ◎ | ○ | Δ | ◎ | Δ | ○ |
| Ex. 19 | No. 7 | ◎ | Δ | ○ | ○ | ○ | ◎ | ◎ |
| Comp. Ex. 6 | Comp. No. 5 | x | ◎ | ○ | ○ | Δ | x | x |
| Comp. Ex. 7 | Comp. No. 6 | ◎ | x | ○ | Δ | ○ | ◎ | ◎ |
| Comp. Ex. 8 | Comp. No. 7 | x | ◎ | ◎ | ○ | ○ | x | x |
| Comp. Ex. 9 | Comp. No. 8 | ◎ | x | x | x | Δ | Δ | ○ |
| Comp. Ex. 10 | Comp. No. 9 | x | ◎ | ○ | ○ | Δ | Δ | x |
| Comp. Ex. 11 | No. 7 | ◎ | x | ◎ | ◎ | ◎ | ◎ | ◎ |

Synthesis Example 5 (resin)

| | |
|---|---|
| Styrene | 85 wt. part(s) |
| Butyl acrylate | 15 wt. part(s) |
| Monobutyl maleate | 0.5 wt. part(s) |
| Di-tert-butyl peroxide | 2 wt. part(s) |

The above monomer composition was mixed with 200 wt. parts of xylene heated to the refluxing temperature, and the solution polymerization was completed within 6 hours under xylene reflux to obtain a solution of low-temperature softening resin.

On the other hand, the following monomer composition was mixed and dispersed in suspension within 200 wt. parts of degassed water containing 0.2 wt. part of polyvinyl alcohol.

| | |
|---|---|
| Styrene | 70 wt. part(s) |
| Butyl acrylate | 25 wt. part(s) |
| Monobutyl maleate | 5 wt. part(s) |
| Benzoyl peroxide | 0.1 wt. part(s) |

The resultant suspension liquid was held at 78° C. under nitrogen atmosphere for 24 hours to complete polymerization, followed by de-watering and drying to obtain a high-temperature softening resin.

25 wt. parts of the high-temperature softening resin was added to the solution containing 75 wt. parts of the low-temperature softening resin just after the polymerization for complete mixing and dissolution, followed by vacuum distillation at a high temperature (180° C.) to obtain an objective styrene-based copolymer composition.

The resin showed a viscosity of $1.1\times10^4$ poise at 150° C.

Synthesis Example 6 (resin)

| | |
|---|---|
| Styrene | 90 wt. parts |
| Butyl acrylate | 10 wt. parts |
| Lauroyl peroxide | 4 wt. parts |

The above monomer composition was dissolved and mixed within 400 wt. parts of toluene at room temperature. Then, the toluene mixture solution was heated to 85° C. under stirring, followed by 10 hours of polymerization to complete the reaction and distilling-off of the toluene to obtain an objective low-temperature softening resin.

67 wt. parts of the low-temperature softening resin was dissolved in the following monomer composition to form a mixture solution.

| | |
|---|---|
| Styrene | 55 wt. part(s) |
| Butyl acrylate | 40 wt. part(s) |
| Monobutyl maleate | 5 wt. part(s) |
| Divinylbenzene | 0.4 wt. part(s) |
| Benzoyl peroxide | 1.2 wt. part(s) |

Into the above mixture solution, 250 wt. parts of degassed water containing 0.1 wt. part of partially saponified polyvinyl alcohol to form a suspension liquid. Into a reaction vessel containing 15 wt. parts of water and aerated with nitrogen, the above suspension liquid was added and subjected to 10 hours of suspension polymerization at 80° C. After the reaction, the product was subjected to steam distillation, separated by filtration, sufficiently dewatered and dried to obtain an objective styrene copolymer composition, which showed a viscosity of $3.2\times10^5$ poise at 150° C.

Comparative Synthesis Example 3 (resin)

The high-temperature softening resin and low-temperature softening resin in Synthesis Example 5 in amounts of 85 wt. parts and 15 wt. parts, respectively, were mixed with each other to obtain a styrene-based copolymer composition, which showed a viscosity of $6.6\times10^6$ poise at 150° C.

Production Example 13 (magnetic material)

Commercially available spherical magnetite ($\phi=0.91$) having a BET specific surface area of 6.8 $m^2/g$ and 0.8 wt. % thereof of silica fine powder having a BET specific surface area of 400 $m^2/g$ were blended with each other by Mix-maller to secure the silica fine powder to the magnetite surface, thus obtaining magnetic material No. 13. The physical properties, etc., of magnetic material No. 13 are summarized in Table 6 appearing hereinafter.

As a result of fluorescent X-ray analysis, magnetic material No. 13 was found to contain an amount of the silica substantially identical to that of the charged silica but showed a low B/A ratio (i.e., a rate of increase in BET specific surface area) of 0.43. This means that the silica fine powder was secured to the magnetic material in a form embedded within the magnetic material surface.

30 g of magnetic material No. 13 was placed in an Erlenmeyer flask and sufficiently stirred together with 200 cc of water and a small amount of surfactant, followed by 3 min. of ultrasonic washing. Then, the washing liquid was discarded while preventing the flow out of the magnetic material by using a magnet. Then, the magnetic material was subjected to two times of washing each with 200 cc of water under sufficient stirring followed by discarding of the washing water. The magnetic material No. 13 was then subjected to quantitative analysis of surface silica by fluorescent X-ray analysis. As a result, substantially no change in amount of the attached silica was detected compared with that before the washing, whereby it was confirmed that the silica fine powder was secured to the magnetite surface.

Production Example 14 (magnetic material)

Magnetic material No. 14 was prepared in the same manner as in Production Example 13 except that the blending intensity and the kind and addition amount of silica fine powder were changed. The physical properties, etc., of magnetic material No. 14 are also shown in Table 6.

Magnetic material No. 14 was washed and subjected to fluorescent X-ray analysis in the same manner as in Production Example 13, whereby at least 95% of silica compared with that before the washing was detected, thus showing the securing of the silica to the magnetite surface.

Production Example 15 (magnetic material)

Magnetic material No. 15 was prepared in the same manner as in Production Example 13 except that spherical magnetite ($\phi=0.90$) having a BET specific surface area of 5.2 $m^2/g$ was blended with 0.8 wt. % thereof of silica fine powder having a BET specific surface area of 230 $m^2/g$. The physical properties, etc., of magnetic material No. 15 are also shown in Table 6.

Magnetic material No. 15 was washed and subjected to fluorescent X-ray analysis in the same manner as in Production Example 13, whereby at least 95% of silica compared with that before the washing was detected, thus showing the securing of the silica to the magnetite surface.

Production Example 16 (magnetic material)

Magnetic material No. 16 was prepared in the same manner as in Production Example 15 except that 2.0 wt. % of silica fine powder having a BET specific surface area of 130 $m^2/g$ was blended with the magnetite by means of a ball mill. The physical properties, etc., of magnetic material No. 16 are also shown in Table 6.

Magnetic material No. 16 was washed and subjected to fluorescent X-ray analysis in the same manner as in Production Example 13, whereby at least 95% of silica compared with that before the washing was detected, thus showing the securing of the silica to the magnetite surface.

Production Example 17 (magnetic material)

Magnetic material No. 17 was prepared in the same manner as in Production Example 16 except that 0.4 wt. % of the silica was blended with spherical magnetite having a BET specific surface area of 6.8 $m^2/g$ by means of a ball mill. The physical properties, etc., of magnetic material No. 17 are also shown in Table 6.

Magnetic material No. 17 was washed and subjected to fluorescent X-ray analysis in the same manner as in Production Example 13, whereby at least 95% of silica compared with that before the washing was detected, thus showing the securing of the silica to the magnetite surface.

Production Example 18 (magnetic material)

Magnetic material No. 18 was prepared in the same manner as in Production Example 17 except that 1.2 wt. % of titania fine powder having a BET specific surface area of 110 $m^2/g$ was blended with the magnetite. The physical properties, etc., of magnetic material No. 18 are also shown in Table 6.

Magnetic material No. 18 was washed and subjected to fluorescent X-ray analysis in the same manner as in Production Example 13, whereby at least 95% of titania compared with that before the washing was detected, thus showing the securing of the titania to the magnetite surface.

Production Example 19 (magnetic material)

Magnetic material No. 19 was prepared in the same manner as in Production Example 16 except that 0.8 wt. % of silica fine powder having a BET specific surface area of 230 $m^2/g$ was blended with hexahedral magnetite having a BET specific surface area of 7.5 $m^2/g$. The physical properties, etc., of magnetic material No. 19 are also shown in Table 6.

Magnetic material No. 19 was washed and subjected to fluorescent X-ray analysis in the same manner as in Production Example 13, whereby at least 95% of silica compared with that before the washing was detected, thus showing the securing of the titania to the magnetite surface.

Comparative Production Example 10 (magnetic material)

The spherical magnetite ($\phi=0.91$) having a BET specific surface area of 6.8 $m^2/g$ used in Production Example 13 was used as comparative magnetic material No. 10.

Comparative Production Example 11 (magnetic material)

Comparative magnetic material No. 11 was prepared in the same manner as in Production Example 17 except that 6.0 wt. % of the silica fine powder was blended with the magnetite. The physical properties, etc., thereof are also shown in Table 6.

Comparative Production Example 12 (magnetic material)

0.8 wt. % of silica fine powder having a BET specific surface area of 230 $m^2/g$ was blended with spherical magnetite ($\phi=0.91$) having a BET specific surface area of 6.8 $m^2/g$ very weakly by means of a Nauter mixer to obtain comparative magnetic material No. 12. The physical properties, etc., thereof are also shown in Table 6.

As shown in Table 6, comparative magnetic material No. 12 showed a ratio $B/(0.01\times C\times D)$ (representing a ratio of the actual increase in BET specific surface area to the theoretical increase in BET specific surface area due to the silica fine powder affixing treatment) which was as low as 0.38. This means that a very small proportion of the added silica was present at the surface of the magnetite, and the remainder was present in an isolated form without being affixed to the magnetite surface.

Comparative magnetic material No. 12 was washed and subjected to fluorescent X-ray analysis in the same manner as in Production Example 13, whereby only 62% of silica compared with that before the washing was detected, thus showing the isolation of silica due to the washing. As described above, this result also indicates that the silica was not secured to the magnetite surface.

TABLE 6

| Magnetic material | Inorganic fine particles | A ($m^2/g$) | $\phi$ | B ($m^2g$) | C (wt. %) | 30 × C | D ($m^2/g$) | B/A | B/ (0.01 × C × D) | Blend intensity* | Blender |
|---|---|---|---|---|---|---|---|---|---|---|---|
| No. 13 | silica | 6.8 | 0.91 | 2.9 | 0.8 | 24 | 400 | 0.43 | 0.91 | medium | Mix-maller |
| No. 14 | silica | 6.8 | 0.91 | 3.1 | 2.0 | 60 | 130 | 0.46 | 1.20 | slightly weak | Mix-maller |
| No. 15 | silica | 5.2 | 0.90 | 2.1 | 0.8 | 24 | 230 | 0.40 | 1.14 | medium | Mix-maller |
| No. 16 | silica | 5.2 | 0.90 | 2.7 | 2.0 | 60 | 130 | 0.52 | 1.04 | medium | ball mill |
| No. 17 | silica | 6.8 | 0.91 | 0.8 | 0.4 | 12 | 130 | 0.12 | 1.53 | medium | ball mill |
| No. 18 | titania | 6.8 | 0.91 | 1.1 | 1.2 | 36 | 110 | 0.16 | 0.83 | medium | ball mill |
| No. 19 | silica | 7.5 | 0.73 | 1.7 | 0.8 | 24 | 230 | 0.23 | 0.92 | medium | ball mill |
| Comparative | | | | | | | | | | | |
| No. 10 | — | 6.8 | 0.91 | — | — | — | — | — | — | — | — |
| No. 11 | silica | 6.8 | 0.91 | 8.2 | 6.0 | 180 | 130 | 1.21 | 1.05 | medium | ball mill |
| No. 12 | silica | 6.8 | 0.91 | 0.7 | 0.8 | 24 | 230 | 0.10 | 0.38 | very weak | Nauter mixer |

A: Specific surface area of magnetic material
B: increase in specific surface area of magnetic material after blending with inorganic fine particles
C: amount of inorganic fine particles added
D: specific surface area of inorganic fine particles
*: The blend intensity was indicated relatively in comparison with that in Production Example 13.

EXAMPLE 20

| | |
|---|---|
| Magnetic material No. 13 | 100 wt. part(s) |
| Resin of Synthesis Example 5 | 100 wt. part(s) |
| Negative charge control agent (Cr complex of azo dye) | 0.6 wt. part(s) |
| Low-molecular weight polypropylene | 4 wt. part(s) |

A blend of the above ingredients was melt-kneaded at 130° C. by means of a twin-screw extruder. The kneaded product was cooled, coarsely crushed by a hammer mill and finely pulverized by a pneumatic classifier to obtain a magnetic toner having a weight-average particle size (diameter) of 6.8 μm.

100 wt. parts of the magnetic toner was blended with 1.2 wt. parts of silica fine powder to obtain a magnetic developer.

Separately, a commercially available laser beam printer ("LBP-8II", mfd. by Canon K. K.) was re-modeled with respect to its apparatus unit (toner cartridge) into one as shown in FIG. 1, wherein a urethane rubber-made elastic blade (9) was abutted to an aluminum developing sleeve at an abutting pressure of 30 g/cm.

Then, the above-prepared magnetic developer was incorporated in the re-modeled laser beam printer and used for image formation in the following manner. An OPC photosensitive drum was primarily charged at −600 V, and an electrostatic latent image for reversal development was formed thereon. The developer was formed in a layer on a developing sleeve 6 (containing magnet) so as to form a clearance (300 μm) from the photosensitive drum at the developing position. An AC bias (f=1,800 Hz and Vpp=1,300 V) and a DC bias ($V_{DC}$=−450 V) were applied to the sleeve, and an electrostatic image formed on the photosensitive drum was developed by the reversal development mode, to form a magnetic toner image on the OPC photosensitive drum. The thus-formed toner image was transferred to plain paper under application of a positive transfer voltage, and then fixed to the plain paper by passing through a hot-pressure roller fixer at 150° C. at a fixing speed of 24 mm/sec (equivalent to that in "LBP-A404"; corresponding to four A4-sheets/min).

In this way, a successive printing test was performed up to 3000 sheets while replenishing the developer, as required, under the conditions of normal temperature—normal humidity (23° C.-60% RH), high temperature—high humidity (32° C.-85% RH) and low temperature—low humidity (15° C.-10% RH), respectively.

The images were evaluated with respect to an image density as measured by a MacBeth reflection densitometer, and image quality as an overall evaluation of factors, such as toner scattering, lack of images, image irregularity and thin-line reproducibility by eye observation.

Further, the fixability and anti-offset characteristic were evaluated in the same manner as in Example 1.

The photosensitive member (drum) after the 3000 sheets of printing test was evaluated with respect to surface damage and toner sticking caused thereby.

Further, the storage characteristic of the magnetic developer was evaluated by subjecting 10 g of the developer placed in a plastic cup to standing at 50° C. for 2 days are then observed the developer as to the presence of lumps or agglomerates of the developer.

The results are shown in Table 7 appearing hereinafter together with the following Examples and Comparative Examples.

EXAMPLE 21

| | |
|---|---|
| Magnetic material No. 13 | 80 wt. part(s) |
| Resin of Synthesis Example 5 | 100 wt. part(s) |
| Negative charge control agent (Cr complex of alkylsalicylic acid) | 1 wt. part(s) |
| Low-molecular weight polypropylene | 4 wt. part(s) |

A blend of the above ingredients was melt-kneaded, pulverized and classified in the same manner as in Example 20 to obtain a magnetic toner having a weight-average particle size of 8.5 μm.

100 wt. parts of the magnetic toner was blended with 0.6 wt. % of silica fine powder to obtain a magnetic developer.

The magnetic developer was subjected to the printing test and evaluation in the same manner as in Example 20.

EXAMPLES 22-27

Magnetic developers were prepared in the same manner as in Example 1 except that the magnetic material was replaced by magnetic materials Nos. 14–19, respectively, and subjected to the printing test and evaluation in the same manner as in Example 20.

EXAMPLE 28

A magnetic developer was prepared in the same manner as in Example 20 except that the resin was replaced by one of Synthesis Example 6, and subjected to the printing test and evaluation in the same manner as in Example 20.

Comparative Example 12

A magnetic developer was prepared in the same manner as in Example 20 except that the magnetic material was replaced by comparative magnetic material No. 10, and subjected to the printing test and evaluation in the same manner as in Example 20.

Comparative Examples 13 and 14

Magnetic developers were prepared in the same manner as in Example 20 except that the magnetic material was replaced by comparative magnetic materials Nos. 11 and 12, respectively, and subjected to the printing test and evaluation in the same manner as in Example 20.

Comparative Example 15

A magnetic developer was prepared in the same manner as In Example 20 except that the resin was replaced by one of Comparative Synthesis Example 3, and subjected to the printing test and evaluation in the same manner as in Example 20.

The results of the evaluation are summarized in the following Table 7, wherein the evaluation standards for the respective items are identical to those in Tables 2 and 3 except for the following items.

[Image quality]

◎: very good,
○: good,
Δ: practically acceptable
x: not acceptable

[Storage characteristic]

○: good, no lump at all
Δ: practically acceptable, a slight degree of minute lumps present
x: not acceptable, noticeable lumps present

TABLE 7

| Example No. | Anti-offset NT-NH | Fixability NT-NH | Image density NT-NH | Image density HT-HH | Image density LT-LH | Image quality NT-NH | Drum surface HT-HH | Storage characteristic (50° C.) |
|---|---|---|---|---|---|---|---|---|
| Ex. 20 | ◎ | ◎ | ◎ | ◎ | ◎ | ◎ | ◎ | ○ |
| Ex. 21 | ◎ | ◎ | ◎ | ◎ | ◎ | ◎ | ◎ | ○ |
| Ex. 22 | ◎ | ◎ | ◎ | ◎ | ◎ | ◎ | ◎ | ○ |
| Ex. 23 | ◎ | ◎ | ◎ | ◎ | ◎ | ◎ | ◎ | ○ |
| Ex. 24 | ○ | ○ | ○ | ◎ | ○ | ◎ | ◎ | ○ |
| Ex. 25 | Δ | ○ | ○ | ○ | ○ | Δ | Δ | ○ |
| Ex. 26 | ○ | ○ | ○ | Δ | ○ | Δ | Δ | ○ |
| Ex. 27 | ◎ | ○ | ○ | ○ | ○ | ○ | ○ | ○ |
| Ex. 28 | ◎ | Δ | ○ | ○ | ○ | ○ | ◎ | ○ |
| Comp. Ex. 12 | x | ◎ | ○ | ○ | Δ | x | x | Δ |
| Comp. Ex. 13 | ◎ | x | Δ | x | ○ | x | ○ | ○ |
| Comp. Ex. 14 | Δ | ◎ | Δ | x | Δ | x | x | ○ |
| Comp. Ex. 15 | ◎ | x | ◎ | ◎ | ◎ | ◎ | ◎ | ○ |

As described above, according to the present invention, it is possible to obtain a developer showing excellent low-temperature fixability and anti-offset characteristic in combination and also excellent storage characteristic and developing characteristic without causing problems, such as sticking of the developer onto the photosensitive member, by using a binder resin having a specifically low melt-viscosity and a magnetic material surface-treated with inorganic fine particles so as to show specific parameters.

What is claimed is:

1. A magnetic developer for developing electrostatic images, comprising: magnetic toner particles, each containing a binder resin having a melt viscosity of at most $5.0\times10^6$ poise at 150° C. and a magnetic material, wherein said magnetic material is blended with a proportion (C) [wt. %] of inorganic fine particles based on the magnetic material to carry 0.2–5 wt. % of the inorganic fine particles secured to the magnetic material surface, and said magnetic material has a specific surface area (A) [$m^2/g$] before securing of the inorganic fine particles and is provided with an increase in surface area (B) [$m^2/g$] by the securing of the inorganic fine particles;

wherein the parameters A, B and C satisfy the following formulae (1) and (2):

$$0.1 \leqq B/A \leqq 0.8 \quad (1)$$

$$B < 30\times C \quad (2).$$

2. The magnetic developer according to claim 1, wherein the inorganic fine particles secured to the magnetic material surface have been imparted with hydrophobicity.

3. The magnetic developer according to claim 1, wherein the inorganic fine particle have been secured to the magnetic material surface by mechanical treatment.

4. The magnetic developer according to claim 1, wherein the parameters A and B satisfy $0.3 \leqq B/A \leqq 0.6$.

5. The magnetic developer according to claim 1, wherein the parameters B and C satisfy $B<20\times C$.

6. The magnetic developer according to claim 1, wherein the parameters B and C satisfy $B<15\times C$.

7. The magnetic developer according to claim 1, wherein the inorganic fine particles have a BET specific surface area (D) [$m^2/g$] satisfying the following formula (3) in combination with the parameters B and C:

$$0.4 \leqq B/(0.01\times C\times D) \leqq 2.5 \quad (3).$$

8. The magnetic developer according to claim 7, wherein the parameters B, C and D satisfy:

$0.6 \leqq B/(0.01 \times C \times D) \leqq 1.8$.

9. The magnetic developer according to claim 1, wherein the magnetic material has a specific surface area of 4–15 $m^2/g$.

10. The magnetic developer according to claim 1, wherein the magnetic material has a specific surface area of 5–12 $m^2/g$.

11. The magnetic developer according to claim 1, wherein the inorganic fine particles have a BET specific surface area of 50–450 $m^2/g$.

12. The magnetic developer according to claim 1, wherein the inorganic fine particles have a BET specific surface area of 80–400 $m^2/g$.

13. The magnetic developer according to claim 1, wherein the magnetic material is contained in an amount of 30–150 wt. parts per 100 wt. parts of the binder resin.

14. The magnetic developer according to claim 1, wherein the magnetic material is contained in an amount of 40–120 wt. parts per 100 wt. parts of the binder resin.

15. The magnetic developer according to claim 1, wherein the inorganic fine particles comprise an inorganic substance selected from the group consisting of silica, titania, alumina, zirconium oxide, magnesium oxide, zinc oxide, cerium oxide, boron nitride, aluminum nitride, and carbon nitride.

16. The magnetic developer according to claim 1, wherein the inorganic fine particles comprise silica.

17. The magnetic developer according to claim 1, wherein the inorganic fine particles comprise alumina.

18. The magnetic developer according to claim 1, wherein the inorganic fine particles comprise titanium oxide.

19. The magnetic developer according to claim 1, wherein the inorganic fine particles have a hydrophobicity of at least 30%.

20. The magnetic developer according to claim 1, wherein the inorganic fine particles have a hydrophobicity of at least 50%.

21. The magnetic developer according to claim 1, wherein the magnetic toner has been blended with 0.1–3 wt. % of inorganic fine powder having a BET specific surface area of at least 50 $m^2/g$.

22. The magnetic developer according to claim 1, wherein the magnetic toner has been blended with 0.1–3 wt. % of inorganic fine powder having a BET specific surface area of at least 100 $m^2/g$.

23. The magnetic developer according to claim 1, wherein the inorganic fine particles are added in a proportion (C) of 0.1–3.5 wt. % of the magnetic material.

24. The magnetic developer according to claim 1, wherein the inorganic fine particles are added in a proportion (C) of 0.2–3 wt. % of the magnetic material.

25. The magnetic developer according to claim 1, wherein said magnetic toner particles have a weight-average particle size of 3–9 $\mu m$.

* * * * *

UNITED STATES PATENT AND TRADEMARK OFFICE

CERTIFICATE OF CORRECTION

PATENT NO. : 5,364,720

DATED : November 15, 1994

INVENTOR(S) : AKIHIKO NAKAZAWA, ET AL.

It is certified that error appears in the above-identified patent and that said Letters Patent is hereby corrected as shown below:

COLUMN 6

Line 54, "of below" should read --is below--.

COLUMN 7

Line 3, "(S)" should read --(B)--.
Line 54, "manganise-copper-aluminum" should read --manganese-copper-aluminum--.

COLUMN 8

Line 19, "Mix-mailer" should read --Mix-maller--.
Line 68, "gasified" should read --a gasified--.

COLUMN 9

Line 43, "pentaerythriol" should read --pentaerythritol--.
Line 60, "small" should read --smaller--.

COLUMN 10

Line 26, "quarternary" should read --quaternary--.
Line 31, "quarternary" should read --quaternary--.

COLUMN 11

Line 34, "interior" should read --the interior--.
Line 37, "as" should read --is--.

COLUMN 12

Line 67, "add" should read --added--.

UNITED STATES PATENT AND TRADEMARK OFFICE

CERTIFICATE OF CORRECTION

PATENT NO. : 5,364,720

DATED : November 15, 1994

INVENTOR(S) : AKIHIKO NAKAZAWA, ET AL.

It is certified that error appears in the above-identified patent and that said Letters Patent is hereby corrected as shown below:

COLUMN 13

Line 16, "he" should read --the--.
Line 40, "temperature" should read --temperature)--.
Line 54, "$A=[6/(\rho \times d_1) \times E,$" should read --$A=[6/(\rho \times d_1)] \times E,$--.

COLUMN 16

Line 34, "Mix-mailer" should read --Mix-maller--.

COLUMN 21

Line 29, "o:" should read --◎:--.

COLUMN 22

Line 6, "o:" should read --◎:--.
Line 11, "o:" should read --◎:--.
Line 18, "o:" should read --◎:--.
Line 25, "o:" should read --◎:--.

COLUMN 24

Line 34, "Mix-mailer" should read --Mix-maller--.
Line 47, "dicarding" should read --discarding--.

COLUMN 27

TABLE 4, " (wt. %) " should read -- C (wt. %) --.

UNITED STATES PATENT AND TRADEMARK OFFICE

CERTIFICATE OF CORRECTION

PATENT NO. : 5,364,720

DATED : November 15, 1994

INVENTOR(S) : AKIHIKO NAKAZAWA, ET AL.

It is certified that error appears in the above-identified patent and that said Letters Patent is hereby corrected as shown below:

COLUMN 32

Line 30, "titania" should read --silica--.

COLUMN 33

TABLE 6, "($m^2g$)" should read --($m^2/g$)--.

COLUMN 34

Line 41, "are then observed" should read --and then observing--.

COLUMN 35

Line 29, "In" should read --in--.

COLUMN 36

Line 33, "particle" should read --particles--.

Signed and Sealed this

Thirtieth Day of May, 1995

Bruce Lehman

*Attest:*

BRUCE LEHMAN

*Attesting Officer*

*Commissioner of Patents and Trademarks*